US007912389B2

(12) United States Patent
Yamamoto et al.

(10) Patent No.: US 7,912,389 B2
(45) Date of Patent: Mar. 22, 2011

(54) IMAGE FORMING APPARATUS

(75) Inventors: Takeshi Yamamoto, Yokohama (JP); Manami Haraguchi, Yokohama (JP); Kenta Kubo, Suntou-gun (JP); Yoshinobu Baba, Yokohama (JP); Koh Ishigami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 641 days.

(21) Appl. No.: 12/022,575

(22) Filed: Jan. 30, 2008

(65) Prior Publication Data

US 2008/0187338 A1 Aug. 7, 2008

(30) Foreign Application Priority Data

Feb. 2, 2007 (JP) ..... 2007-024925

(51) Int. Cl.
*G03G 15/08* (2006.01)

(52) U.S. Cl. ..... 399/55; 399/285

(58) Field of Classification Search ..... 399/55, 399/265, 270, 279, 285
See application file for complete search history.

(56) References Cited

U.S. PATENT DOCUMENTS

| | | | |
|---|---|---|---|
| 2005/0089340 | A1 | 4/2005 | Yamamoto |
| 2005/0142478 | A1 | 6/2005 | Matsumura et al. |
| 2007/0071473 | A1 | 3/2007 | Haraguchi et al. |

FOREIGN PATENT DOCUMENTS

| | | | |
|---|---|---|---|
| JP | 2005-195674 | A | 7/2005 |

*Primary Examiner* — David M Gray
*Assistant Examiner* — Gregory H Curran
(74) *Attorney, Agent, or Firm* — Fitzpatrick, Cella, Harper & Scinto

(57) ABSTRACT

An image forming apparatus, wherein the following formulae are satisfied:

$$0.22 \le (M/S)_L \le 0.4,$$

$$\left(\frac{Q}{M}\right)_L = \frac{Vc}{\left(\frac{Lt}{2\varepsilon_0\varepsilon_t} + \frac{Ld}{\varepsilon_0\varepsilon_d}\right)\times\left(\frac{M}{S}\right)_L}$$

$$\frac{\frac{(Dt\max - Dt_{0.1})}{\left\{\lambda\times\left(\frac{M}{S}\right)_L - 0.1\right\}}\left(\frac{Lt}{2\varepsilon_0\varepsilon_t} + \frac{Ld}{\varepsilon_0\varepsilon_d}\right)\times\left(\frac{M}{S}\right)_L}{500} \le \alpha\beta \le \frac{\frac{(Dt\max - Dt_{0.1})}{\left\{\lambda\times\left(\frac{M}{S}\right)_L - 0.1\right\}}\left(\frac{Lt}{2\varepsilon_0\varepsilon_t} + \frac{Ld}{\varepsilon_0\varepsilon_d}\right)\times\left(\frac{M}{S}\right)_L}{150}$$

$$\alpha\beta \ge \frac{\frac{(Dt\max - Dt_{0.1})}{\left\{\lambda\times\left(\frac{M}{S}\right)_L - 0.1\right\}}}{150}$$

where $(M/S)_L$: a toner bearing amount in a maximum density image portion of a photosensitive drum, $(Q/M)_L$: an average charge amount of the toner in the maximum density portion, Vc: an absolute value of a potential difference between a DC-component of a developing bias and the maximum density portion, Lt: a toner layer thickness of the maximum density portion, Ld: a drum thickness, $\epsilon t$: a relative permittivity of the toner layer, $\epsilon d$: a relative permittivity of the drum, $\epsilon 0$: a vacuum permittivity, Dtmax: a transmission density in a maximum density image portion on the paper after fixation, $Dt_{0.1}$: a transmission density in an image on the paper when the toner bearing amount on the paper after fixation is 0.1 mg/cm$^2$, and $\lambda$: a transfer efficiency of the toner, $$\alpha = \frac{(Dt\max - Dt_{0.1})}{\left\{\lambda\times\left(\frac{M}{S}\right)_L - 0.1\right\}},$$

and $\beta = 1/(Q/M)_L$.

8 Claims, 26 Drawing Sheets

IMAGE FORMING APPARATUS

BACKGROUND OF THE INVENTION

1. Field of the Invention

The present invention relates to an image forming apparatus such as a copying machine or a printer that produce images by visualizing electrostatic images formed on an image bearing member.

2. Description of the Related Art

Recently, as a POD (print on demand) market expands, an electrophotographic image forming apparatus makes an attempt to enter the POD market. An apparatus of higher productivity (a larger number of output prints per unit time) is expected to be introduced.

On the other hand, however, since reduction of power consumption is also required in order to cope with environmental issues, it is not allowed to increase the power consumption largely for increasing the printing speed. Therefore, it is desired to achieve an increase in printing speed and reduction in power consumption at the same time. It is needless to say that a high quality image formation is expected also in terms of image quality.

Under such circumstances, there are large differences between the printing and the electrophotography that uses a toner to form images. One of the differences is a "toner relief" which occurs during image forming. Unlike the printing which uses an ink as a liquid, in the electrophotography in which a toner of powder in nature is fused and fixed onto a transfer material such as a paper by a fixing device with pressure and heat, even the fixed toner has a volume to a certain extent. Consequently, when a high-density portion of a larger toner amount is adjacent to a low-density portion of a smaller toner amount, in a large case, a toner relief of 10 μm or more occurs resulting in an uneven touch on images. The uneven touch may give an undesirable feeling to users who are accustomed to a substantially plane print surface. Therefore, it is desired to be capable of forming images with less toner relief.

In the POD market, particularly, there are requests to use thin papers. For example, it is conceivable that there may be a case that full color images are formed on a thin paper of 40 to 50 g/m$^2$ or less without changing the throughput. However, when images are formed on such a thin paper using a conventional toner amount (toner bearing amount), elasticity of the paper tends to get defeated by a force, which is generated due to a phase change of the toner during fixing process, resulting in a curl generated on the paper. The "phase change of the toner" is a phenomenon in which a powder toner is fused once, and then solidified again to be fixed on a transfer material like a paper. Also the "curl" is a phenomenon such that a transfer material such as a paper fixed with the toner forms a curvature; and generally refers to a phenomenon such that the side, on which the toner exists, of the transfer material such as a paper fixed with the toner forms a curvature into a concave or downwardly rounded surface.

Further, it is strongly requested to reduce the running cost per sheet of color images.

The inventors examined and found that, in order to respond such requests, it is one of the extremely effective techniques to largely reduce the toner amount (toner bearing amount) needed for image forming.

For example, the fixing temperature may be reduced by several dozen degrees by reducing the toner bearing amount to a half. Further, by utilizing the power equivalent to the reduction effect of the fixing temperature, the printing speed can be increased with the same power consumption as that of the conventional art. By reducing the total amount of the toner necessary for forming images to a half, a large effect to reduce the toner relief and the curl is obtained. Furthermore, by reducing the amount of the toner used per an output image sheet, the running cost can be also largely reduced.

Thus, reducing the toner bearing amount is extremely effective to increase the productivity and the applicability to thin papers and to achieve an image quality with a smaller toner relief closer to the image quality of the ordinary printing, by use of the electrophotographic method.

Conventionally, a technique to reduce the toner bearing amount by increasing tinting strength of the toner has been proposed (Japanese Patent Application Laid-Open No. 2005-195674).

However, the examination by the inventor et al. revealed that, for example, after enhancing the tinting strength of the toner by increasing the amount of coloring agent contained in the toner, simply reducing the developing contrast by the amount corresponding thereto to reduce the toner bearing amount may cause the following disadvantages to occur.

Referring to FIG. 12A, a relationship between potential and developing bias on an electrophotographic photosensitive member (hereinafter referred to as "photosensitive member") is illustrated. Developing contrast (Vcont) is a difference between a latent image electrical potential (exposed portion potential) formed on the photosensitive member and a potential Vdc of a DC-component of developing bias in an image forming per one color. The developing bias may be a superimposed voltage of an AC voltage and a DC voltage. Further, a difference between a latent image electrical potential VL formed on the photosensitive member to obtain a maximum toner bearing amount (i.e., maximum density) and the Vdc; i.e., |Vdc−VL| is particularly represented with "Vc" as a maximum value of the developing contrast Vcont (hereinafter also referred to as "maximum developing contrast"). Charge potential (potential in an unexposed portion) of the photosensitive member is represented by "Vd". Potential difference between charge potential Vd in the photosensitive member and potential Vdc of DC-component of the developing bias; i.e., |Vdc−Vd| is referred to as a fog removal bias (Vb).

(1) Increase of γ

FIG. 2 illustrates a relationship between a transmission density Dt and a developing contrast Vcont in a gradation image formed on a paper as a transfer material through the development, transfer and fixing processes (FIG. 3 is the similar graph). A line "a" in FIG. 2 represents a γ-characteristic (gradation characteristic) obtained using a conventional common toner, which is controlled to obtain a maximum density (Dtmax=1.8) at Vc=150 V (point-p).

In this specification, the density of an image is indicated as a transmission density Dt measured on the fixed image using a transmission densitometer TD904 manufactured by the GretagMacbeth AG. In order to describe a relationship between the toner bearing amount and the density under a condition that the influence of gloss caused from a surface condition of a toner layer on a transfer material was removed, the transmission density ⊃t was used. As for the paper as the transfer material, OK Topcoat (73.3 g/m$^2$) from Oji Paper Co., Ltd was used. In the following descriptions, all the paper used was the above coat paper.

The developing contrast Vcont on the abscissa in FIG. 2 is obtained as a difference between the potential of a digital latent image, which is continuously formed on the photosensitive member with varying gradation, and the potential Vdc of DC-component of the developing bias. In order to facilitate the description, FIG. 14 illustrates the potential of a latent image in the case where the latent image electrical potential of the digital latent image of the gradation image is varied in 17 steps. FIG. 14 also schematically illustrates enlarged images in several gradations. That is, (a) in FIG. 14 represents a maximum density image (solid image). Each of (b), (c) and (d) in FIG. 14 also represents a half-tone image respectively, the density of which is lowered in this order. Further, (e) in FIG. 14 represents a minimum density image (blank copy image); i.e. an area to which no toner should be adhered.

As shown in FIG. 13A, a desired latent image is formed on a photosensitive member 1 with an exposing device 3, and the latent image electrical potential thereof was measured with a surface electrometer Vs disposed at the downstream side than the exposing device 3 in a rotational direction of the photosensitive member 1.

The γ-characteristic indicated with the line "a" in FIG. 2 was obtained when the toner was used in which the tinting strength was adjusted so as to obtain the maximum density (Dtmax=1.8) at approximately 0.56 mg/cm$^2$ of the toner bearing amount on the paper. The value of 0.56 mg/cm$^2$ was the toner bearing amount on the paper. The toner bearing amount here was the value after the toner layer of approximately 0.6 mg/cm$^2$ was formed on the photosensitive member in the developing process and after completing the developing process, and the toner layer was transferred on the paper through the transfer process twice via an intermediate transfer member. In this case, the transfer efficiency after the twice transfer processes was approximately 93%. Also, it is assumed that after the fixing process, there has been no change in the toner bearing amount after the completion of transfer process.

In the case of the γ-characteristic indicated with the line "a" in FIG. 2, when the developing contrast Vcont changes, for example, by 25 V (ΔVcont=25 V), the density Dt changes by 0.15 (Δdt=0.15). That is, when the developing contrast changes by ΔVcont=10 V, the density changes by Δdt=0.06.

Ordinarily, an electrophotographic image forming apparatus has various mechanical or electrical fluctuations. For example, ordinarily, the distance (S-D gap) between the developer carrying member and the photosensitive member varies depending on a mechanical tolerance. Also, ordinarily, the value of the bias applied to the developer carrying member subtly changes. That is, the developing contrast Vcont changes a little due to the mechanical or electrical fluctuation.

Therefore, for example, when an image of fully uniform density is formed, the large change in density with respect to the subtle change of the developing contrast Vcont as described above will cause an uneven image in the same area.

Currently, for the density change of Δdt=0.15 or so with respect to the developing contrast change of ΔVcont=25 V, generally, uniformity in an image area can be ensured.

Contrarily, a line "a'" in FIG. 3 indicates the γ-characteristic in the following case. That is, a toner with a double density of a conventional toner (i.e., tinting strength is twice) was used; the developing contrast was set to a half of a conventional contrast (Vc'=(½)×Vc); and the toner bearing amount was set to approximately a half (maximum toner bearing amount on the paper: 0.28 mg/cm$^2$). In FIG. 3, the identical line "a" shown in FIG. 2 is also illustrated.

The inclination of the γ-characteristic indicated with the line "a'" in FIG. 3 is sharper than that of the line "a", in order to achieve Dtmax=1.8 by a half toner bearing amount (point-p') of the case in the γ-characteristic indicated with the line "a".

In the case of the γ-characteristic indicated with the line "a'", it is extremely difficult to obtain the gradation. Further, the density change becomes too high as Δdt'=2 Δdt with respect to the above-mentioned developing contrast change of ΔVcont=25 V. As a result, an image including a large unevenness may be resulted in.

(2) Increase of Coarseness

Between the case of the -characteristic indicated with line "a" in FIG. 2 and FIG. 3 and the case of the -characteristic indicated with the line "a" in FIG. 3, coarseness (smoothness of image) in low density portions (halftone portions) each having the same density was compared. As a result, it was found that, in the low density portion (halftone portion) having the -characteristic indicated with the line "a", the coarseness was largely worsened. The reason of this is understood as described below.

The image in the low density portion (halftone portion) was obtained by developing the latent image electrical potential having a potential indicated with Vh in FIG. 14.

Since Vcont=|Vdc−Vh|≈0, the image has a transmission density at a point in the vicinity of Vcont=0; i.e., approximately Dt=1 in FIG. 2.

The gradation electric potentials in FIG. 14 are latent image electrical potentials of digital latent images obtained while changing the emitting width by PWM (pulse width modulation) in laser exposure. FIG. 14 shows gradation electric potentials obtained based on gradation data of two hundred lines. Therefore, the latent image electrical potential Vh of the actual half-tone image forms non-image areas and image areas alternately, for example, as shown in FIG. 15A. FIG. 15A schematically illustrates an enlarged half-tone image. FIG. 15B schematically illustrates the latent image electrical potential of the half-tone image shown in FIG. 15A.

FIG. 16 schematically illustrates a space electrical potential between the photosensitive member and the developer carrying member. Hereinafter descriptions will be made using the following coordinate system shown in FIG. 16. That is, the main scanning direction (corresponding to the laser scanning direction) is the y-axis; the sub-scanning direction (corresponding to a surface movement direction of the photosensitive member) is the z-axis; and the straight-line direction connecting between the surfaces of the photosensitive member and the developer carrying member is the x-axis. The x-axis, the y-axis and the z-axis are perpendicular to one another.

When the latent image electrical potential Vh on the half-tone image is expressed more precisely, the potential is represented with a repeated potential of Guassian distribution as shown in FIG. 15B. That is, a potential distribution, which has a potential Vha (hereinafter, referred to as "a peak latent image electrical potential in an image area") as a peak potential at the VL side at substantially central point in the main scanning direction of one image area, is repeated. Average potential Vh is obtained by measuring the latent image electrical potential illustrated in FIG. 15B while maintaining a limited distance using a surface electrometer Vs shown in FIG. 13A.

FIGS. 17A and 17B are diagrams each illustrating a potential (space electrical potential) between the photosensitive member and the developer carrying member, which is plotted from the surface of the photosensitive member to the surface of the developer carrying member. In FIGS. 17A and 17B, the plane "y-z" at x=0 represents the potential distribution shown in FIG. 15B.

In FIGS. 15A, 15B, 16, 17A and 17B, Y1 indicates the identical position in the y-axis direction; i.e., particularly, the substantially central point (a peak of a latent image electrical potential in an image area) in the main scanning direction in one image area of a half-tone image.

FIG. 17A illustrates, as an example, changes of the potential when a developing bias of Vdc=300 V is applied to the latent image electrical potential of Vd=450 V, VL=150 V, Vh=310 V, Vha=170 V (calculated value). In this case, from the following formulae:

$$Vc=|Vdc-VL|=150\text{ V; and}$$

$$Vb=|Vdc-Vd|=150\text{ V,}$$

Vc is 150 V, and Vb is 150 V.

Actually, a developing bias of a superimposed AC voltage and DC voltage is applied to the developer carrying member. However, the Vdc may be used as an average potential.

FIG. 17B illustrates, as an example, changes of the potential when a developing bias of Vdc=225 V is applied to a latent image electrical potential of Vd=375 V, VL=150 V, Vh=310 V and Vha=170 V (calculated value). In this case, from the following formulae:

$$Vc=|Vdc-VL|=75\text{ V; and}$$

$$Vb=|Vdc-Vd|=150\text{ V,}$$

Vc is 75 V, and Vb is 150 V.

That is, FIG. 17B illustrates a distribution of the latent image electrical potential when the charge potential Vd and potential Vdc in the DC-component of the developing bias are controlled so that, at the same fog removal bias Vb, Vc'=(½)×Vc with respect to the same image area peak potential Vha as the case of FIG. 17A.

FIG. 18 illustrates an electrical potential distribution, which is extracted at x=40 μm in the space electrical potential shown in FIGS. 17A and 17B; i.e., in a plane (y-z plane) 40 μm away from the photosensitive member toward the developer carrying member. A line "C" in FIG. 18 represents an electrical potential in the y-z plane at x=40 μm in FIG. 17A; while a line "C'" in FIG. 18 represents an electrical potential in the y-z plane at x=40 μm in FIG. 17B. Referring to FIG. 18, it is found that, in the y-direction, the line "C'" has more moderate and wider inclination of the changes of the electrical potential than the line "C".

FIG. 19 illustrates the changes of the electrical potential, which is extracted from a plane of y=Y1 (x-z plane) in the space electrical potential shown in FIGS. 17A and 17B. A line "b" in FIG. 19 represents the changes of the electrical potential in the x-z plane at y=Y1 in FIG. 17A; while a line "b'" in FIG. 19 represents the changes of the electrical potential in the x-z plane at y=Y1 in FIG. 17B. Referring to FIG. 19, it is found that the line "b'" has more moderate and wider inclination of the changes of the electrical potential in the x-direction than the line "b".

That is, when Vc'=(½)×Vc, the inclination of the changes of the electrical potential decrease (become smaller) in a boundary area between the image area and the non-image area in the y-direction and the x-direction. Therefore, the developing position (adhering position) of the toner becomes unstable near the boundary area as shown in FIG. 20B. It is understood that the unstableness is the cause of the "coarseness".

Therefore, when reducing the toner bearing amount, in order to prevent the coarseness from worsening, it is preferable to perform the image forming at a maximum developing contrast Vc equal to or greater than the conventional level.

(3) Worsening of Fogged Image

As for the fogged image; i.e., about a phenomenon of toner adhesion to the non-image area during developing process, the following fact was found. That is, since the toner bearing amount is reduced and the tinting strength of the toner is increased at the same time, the frequency of fogged images tends to be the same as or worse than the conventional art.

As described above, in order to reduce the toner bearing amount, just simply reducing the developing contrast to reduce the toner bearing amount by increasing the tinting strength of the toner and utilizing the thus increased density may decrease the stability and image quality. That is, such problems as unstableness, worsening of coarseness and fogged images may occur. As described above, it is requested to increase the productivity, to reduce the power consumption, the toner relief and the running cost while enabling the reduction of the toner bearing amount without decreasing the conventional stability and the image quality.

SUMMARY OF THE INVENTION

An object of the invention is to provide an image forming apparatus capable of reducing toner bearing amount while preventing decrease of the stability and image quality.

Another object of the invention is to provide an image forming apparatus that prevents an image density from changing with respect to the change in developing contrast.

Still another object of the invention is to provide an image forming apparatus that prevents the developing contrast from reducing when the toner bearing amount is reduced.

Yet another object of the invention is to provide an image forming apparatus that prevents the worsening of fogged image even if the toner bearing amount is reduced.

Objects and characteristics of the invention will be further clarified by reading the following detailed descriptions while referring to accompanying drawings.

DESCRIPTION OF THE EMBODIMENTS

Figure 1:
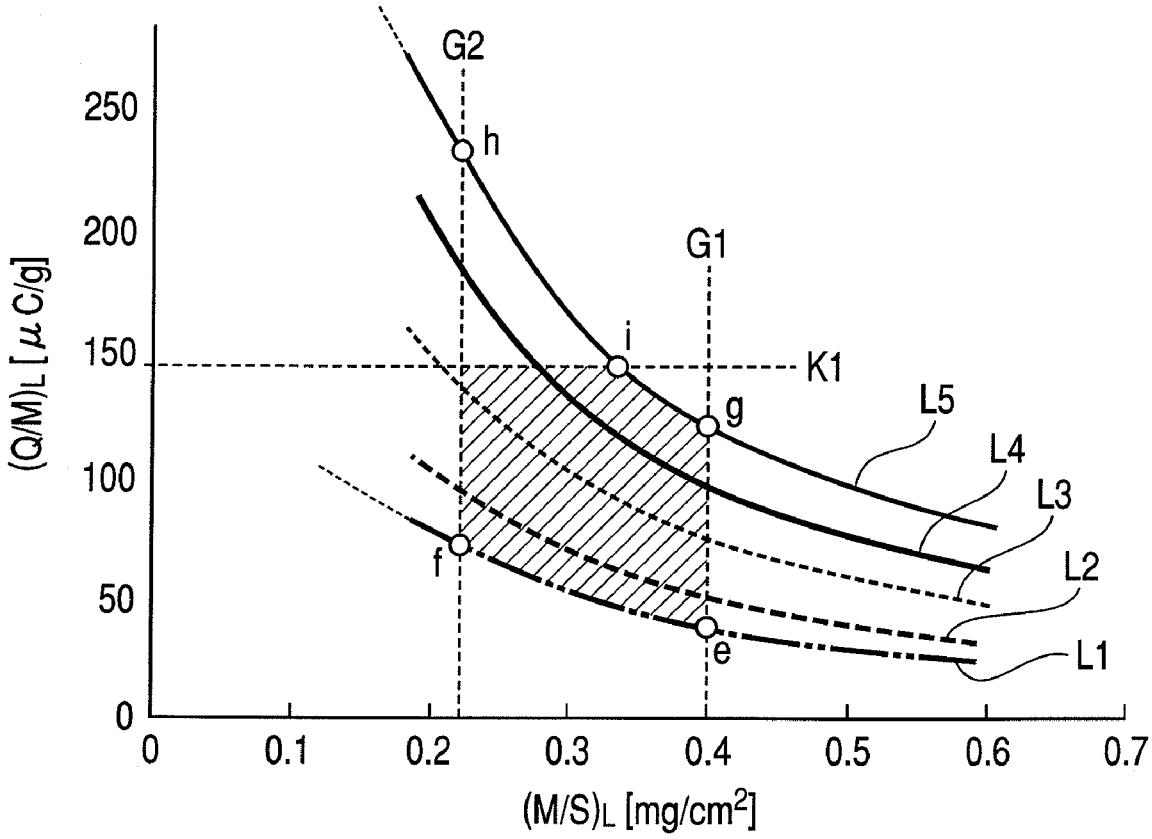
FIG. 1 is a graph for illustrating a range of a toner bearing amount and a range of a toner charge amount according to the invention.

Referring now to the drawings, an image forming apparatus according to the invention will be described in detail below.

Embodiment 1

[Entire Constitution and Operation of the Image Forming Apparatus]

Figure 21:
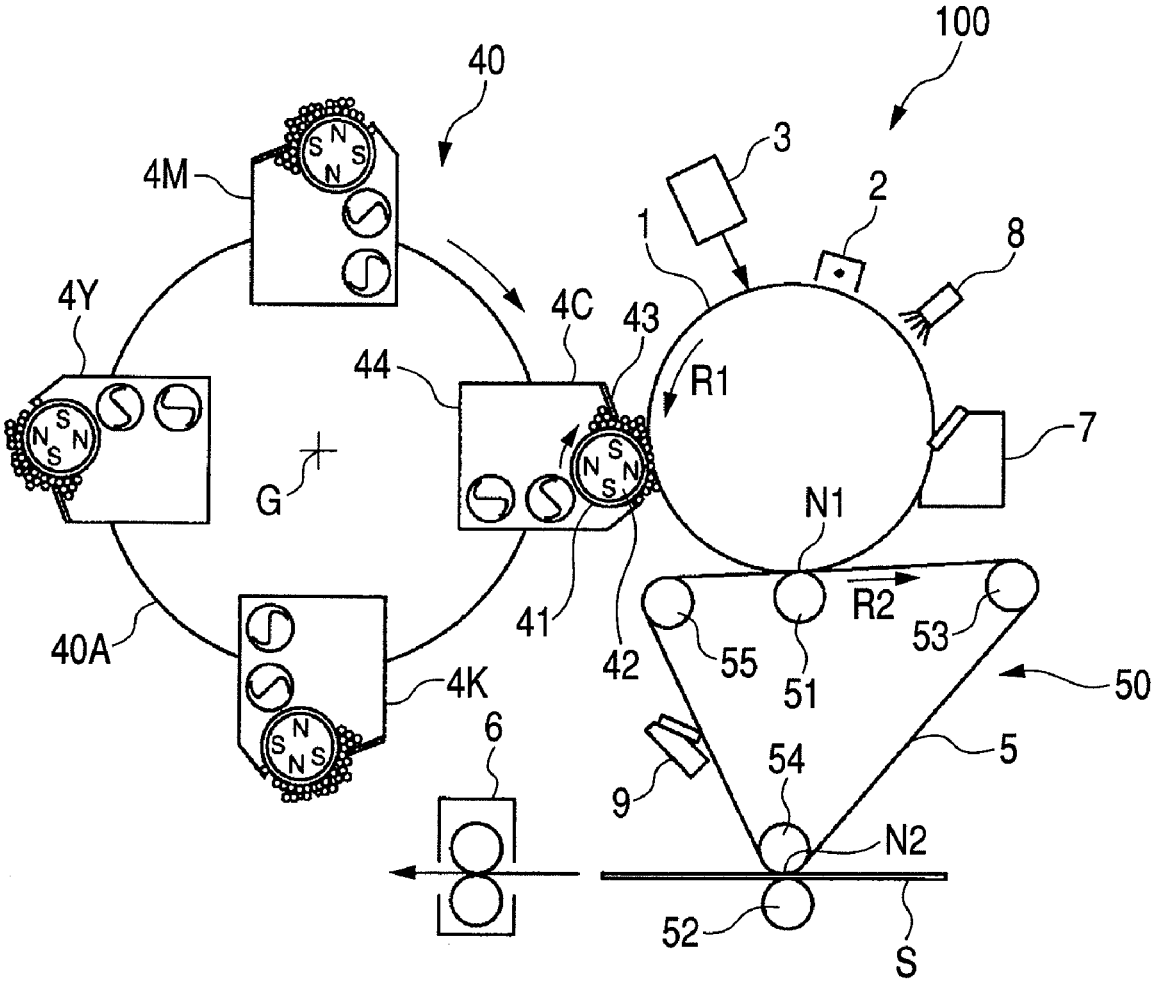
FIG. 21 is a schematic cross sectional view of one embodiment of an image forming apparatus to which the invention is applicable.

First of all, an entire constitution and an operation of the image forming apparatus according to one embodiment of the invention will be described. FIG. 21 schematically illustrates a sectional constitution of relevant parts of an image forming apparatus 100 of the embodiment.

The image forming apparatus 100 has a cylindrical photosensitive member (photosensitive drum) 1 as an image bearing member. Around the photosensitive member 1, a charging device 2 as a charging unit, an exposing device 3 as an exposing unit, a rotary developing apparatus 40, an intermediate transfer unit 50, a cleaner 7 as a cleaning unit, a pre-exposing device 8 as a pre-exposing unit are disposed.

The rotary developing apparatus 40 has developing devices 4Y, 4M, 4C and 4K as developing units each performing development using toners of yellow (Y), magenta (M), cyan (C) and black (K) respectively. In this embodiment, the developing devices 4Y, 4M, 4C and 4K for respective colors are substantially identical to one another in constitution and operation excepting a point that each of the devices uses toner of a color different from one another. Therefore, hereinafter, if not particularly specified, the suffixes Y, M, C and K each attached to the reference numeral for indicating a particular color will be omitted and the description of the developing devices will be given as a whole.

The intermediate transfer unit 50 has an intermediate transfer member (an intermediate transfer belt) 5 of an endless belt-state disposed being opposite to the photosensitive member 1. The intermediate transfer member 5 is laid around on a drive roller 53, a secondary transfer opposed-roller 54 and a tension roller 55 as a plurality of supporting members. On the inner periphery side of the intermediate transfer member 5, a primary transfer roller 51 is disposed as a primary transfer device at a position opposite to the photosensitive member 1. The primary transfer roller 51 presses the intermediate transfer member 5 onto the photosensitive member 1 to form a nip (a primary transfer nip) at a primary transfer portion N1 where the photosensitive member 1 and the intermediate transfer member 5 are in contact with each other. Also, at a position opposite to the secondary transfer opposed-roller 54, a secondary transfer roller 52 is disposed as a secondary transfer device being interposed by the intermediate transfer member 5. The secondary transfer roller 52 is disposed in contact with the intermediate transfer member 5 to form a nip (a secondary transfer nip) at a secondary transfer portion N2. In this embodiment, a transfer unit includes the primary transfer roller 51, the intermediate transfer member 5 and the secondary transfer roller 52; thereby an image formed with toner on the photosensitive member 1 is transferred to a transfer material S.

Further, the image forming apparatus 100 has a fixing device 6 as a fixing unit for fixing the toner to the transfer material S at the downstream than the secondary transfer portion N2 in a conveying direction of the transfer material S.

Figure 25:
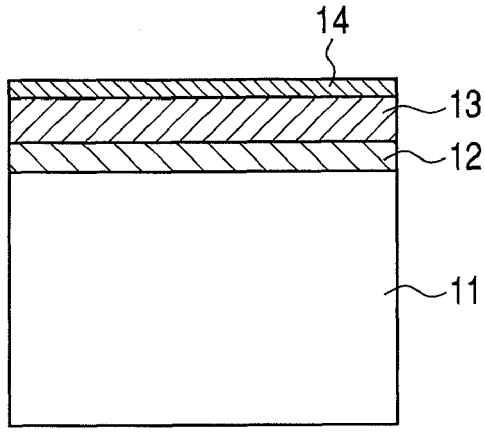
FIG. 25 is a schematic sectional view for illustrating an example of layer structure of a photosensitive member.
Figure 26A:
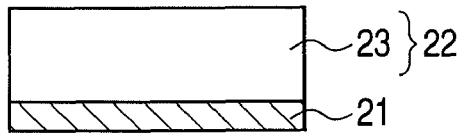
FIGS. 26A, 26B, 26C and 26D are schematic sectional views for illustrating other examples of layer structure of a photosensitive member.
Figure 26B:
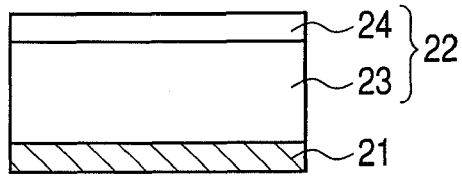
Figure 26C:
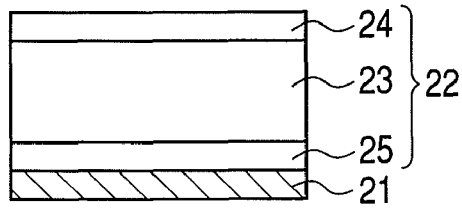
Figure 26D:
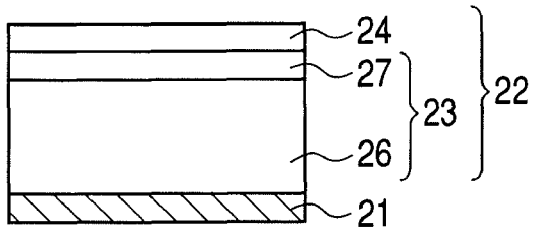

For the photosensitive member 1, a common OPC (an organic photoconductor) photosensitive member or an a-Si (amorphous silicon) photosensitive member may be employed. The OPC photosensitive member has a photosensitive layer (a photosensitive film) formed on a conductive base. The photosensitive layer has a photoconductive layer formed of an organic photoconductor as a main component. As illustrated in FIG. 25, the OPC photosensitive member generally includes a charge generation layer 12 formed of an organic material, an charge transport layer 13 and a surface protection layer 14 which are stacked on a metal base (a support member for a photosensitive member) 11 as a conductive base. The a-Si photosensitive member has a photosensitive layer (a photosensitive film) that includes a photoconductive layer of amorphous silicon as a major component formed on a conductive base. Generally, the a-Si photosensitive member has the following layer structures. That is, an a-Si photosensitive member illustrated in FIG. 26A is provided with a photosensitive film 22 formed on a photosensitive member support (conductive base) 21. The photosensitive film 22 is composed of a-Si: H, X (H is hydrogen atom, X is halogen atom) and includes a photoconductive layer 23 having photoconductivity. An a-Si photosensitive member illustrated in FIG. 26B is provided with the photosensitive film 22 formed on the photosensitive member support 21. The photosensitive film 22 is composed of a-Si: X, X and includes a photoconductive layer 23 having photoconductivity and an amorphous silicon surface layer 24. An a-Si photosensitive member illustrated in FIG. 26C is provided a photosensitive film 22 formed on the photosensitive member support 21. The photosensitive film 22 is composed of a-Si: H, X and includes a photoconductive layer 23 having photoconductivity, an amorphous silicon surface layer 24 and an amorphous silicon charge injection blocking layer 25. An a-Si photosensitive member illustrated in FIG. 26D is provided with a photosensitive film 22 formed on the photosensitive member support 21. The photosensitive film 22 includes a photoconductive layer 23 and an amorphous silicon surface layer 24. The photoconductive layer 23 includes a charge generation layer 26 composed of a-Si: H, X and a charge transport layer 27.

The layer structure of the photosensitive member 1 is not limited to the above-described layer structures, but any photosensitive member of a different layer structure may be used.

It should be noted that the film thickness of the photosensitive member means the thickness of the photosensitive layer (the photosensitive film) including the photoconductive layer; herein, the total thickness of the layers formed on the conductive base.

The capacitance (capacitance per unit area) C of the photosensitive member is preferred to be within a range expressed by the following calculation:

$$0.7\times10^{-6}\ \mathrm{F/M^2}<C<2.7\times10^{-6}\ \mathrm{F/M^2}$$

The reason of this is described below.

For example, in the case of common OPC photosensitive member, the film thickness to obtain the above capacitance is; approximately 11 μm<film thickness of photosensitive member<40 μm.

For the OPC photosensitive member, it is known that the thicker the film, the poorer the thin line reproducibility. That is, when the film is too thick, electrical potentials generated by the adjoining lines interfere with each other. As a result, the potential gets shallow and looses its sharpness; and as a result, the thin line reproducibility may be degraded. According to examinations conducted by the inventors, in an OPC photosensitive member of 40 μm or more in film thickness under a desired electrical potential setting, for example, thin lines formed at a resolution of about 1200 dpi may not reproduced satisfactorily. Contrarily, when the film thickness of the OPC photosensitive member is 11 μm or less, the film hardly assumes a uniform coating. Therefore, unevennesses in charging characteristic and photoconductivity characteristic are generated resulting in a problem like an uneven density. Further, when the toner bearing amount is $(M/S)_L$=0.22 mg/cm$^2$, the charge amount of the toner required for satisfying the charging efficiency of 100%, which will be described later, exceeds approximately −150 μC/g at Vcont=150 V developing contrast setting required for obtaining a desired density stability. Therefore, it may be extremely difficult to ensure developability.

On the other hand, for the a-Si photosensitive member, the film thickness of photosensitive member that satisfies the above capacitance is approximately 33 μm<film thickness of photosensitive member<120 μm.

The a-Si photosensitive member has the permittivity almost three times as large as that of the OPC photosensitive member. Therefore, for example, under the same electrical potential setting, the a-Si photosensitive member requires a charge density almost three times as large as that of the OPC photosensitive member for generating the electrical potential. Also, compared to the OPC photosensitive member, the a-Si photosensitive member has the charge generating position closer to the surface of the photosensitive member. Therefore, little charge diffuses within the photosensitive member. From the above-described facts, the following is found. That is, even when the photosensitive member has a large film thickness, the a-Si photosensitive member is less likely to loose the sharpness of the electrostatic potential on the photosensitive member. However, when the film thickness of the a-Si photosensitive member is 120 μm or more, the charge density for forming the latent image electrical potential is substantially equal to that of the OPC photosensitive member of 40 μm in film thickness. Therefore, the thin line reproducibility may decrease. Also, since when the film thickness of the a-Si photosensitive member becomes large, a dark decay amount also increases, the charge potential may be hardly controlled. Contrarily, when the film thickness of the a-Si photosensitive member becomes 33 μm or less, same as the case of the OPC photosensitive member, unevenness is generated in the photoconductivity characteristic resulting in a problem such as unevenness of the density. Further, when the toner bearing amount is $(M/S)_L$=0.22 mg/cm$^2$, under Vcont=150 V developing contrast setting required for obtaining a desired density stability, the charge amount of the toner required for satisfying the charging efficiency of 100% exceeds approximately −150 μC/g. Therefore, it may become extremely difficult to ensure developability.

Consequently, the capacitance (capacitance per unit area) C of the photosensitive member can be within a range expressed by the following calculation:

$$0.7\times10^{-6}\ \mathrm{F/m^2}<C<2.7\times10^{-6}\ \mathrm{F/m^2}.$$

The photosensitive member 1 is driven to rotate at a predetermined circumferential speed in a direction indicated by an arrow R1 (counterclockwise direction) in FIG. 21. The surface of the rotating photosensitive member 1 is electrically charged to a predetermined polarity (in this embodiment, negative polarity) substantially uniformly by the charging device 2. Then, at a position opposite to the exposing device 3, the photosensitive member 1 is irradiated with a laser beam emitted from the exposing device 3 according to an image signal. Thus, an electrostatic image (latent image electrical potential) corresponding to an original image is formed on the photosensitive member 1.

When the electrostatic image formed on the photosensitive member 1 reaches the position opposite to the developing device 4 due to the rotation of the photosensitive member 1, the electrostatic image is developed as a toner image by the developing device 4. In this embodiment, the developing device 4 uses a two-component developer as the developer that mainly includes non-magnetic toner particles (toner) and magnetic carrier particles (carrier) (two component developing system). The electrostatic image is developed with substantially only the toner of the two-component developer.

In this embodiment, a plurality (in the embodiment: four) of developing devices 4Y, 4M, 4C and 4K is mounted onto a developing device support member (rotor) 40A rotatable about a rotation center G, each of the developing devices contains a different color toner respectively. By rotating the developing device support member 40A, a desired developing device can be positioned at the developing position opposite to the photosensitive member 1. By positioning a desired developing device at the developing position opposite to the photosensitive member 1 by rotating the developing device support member 40A, and by performing the development of the electrostatic image on the photosensitive member 1 sequentially, the respective color toner images can be formed on the photosensitive member 1.

The developing device 4 has a developing container (a developing device body) 44 containing the two-component developer. The developing container 44 is provided with a hollow cylindrical developing sleeve 41 as a developer carrying member. The developing sleeve 41 is disposed rotatably so that a part thereof is exposed from an opening of the developing container 44. The developing sleeve 41 includes a magnet 42 therein as a magnetic field generating unit. According to the embodiment, the developing sleeve 41 is driven to rotate so that the surface thereof moves to the same direction as the movement direction of the surface of the photosensitive member 1 at a portion opposite to the photosensitive member 1 (developing portion).

The two-component developer in the developing container 44 is supplied onto the surface of the developing sleeve 41, and then the amount thereof is controlled by a regulating member 43 disposed opposite to the surface of the developing sleeve 41. Then, the two-component developer is carried on the developing sleeve 41 and transported to the developing portion opposite to the photosensitive member 1. The carrier has a function to support and transport the charged toner to the developing portion. Being mixed with the carrier, the toner is charged to a predetermined charge amount of a predetermined polarity by the frictional charge.

At the developing portion, the two-component developer takes the shape of "ears of rice" on the developing sleeve 41 by a magnetic field generated by the magnet 42, thereby a magnetic brush is formed. Then, according to the embodiment, the magnetic brush is brought into contact with the surface of the photosensitive member 1 and a predetermined developing bias is applied to the developing sleeve 41, thereby substantially only the toner is transferred to the electrostatic image on the photosensitive member 1 from the two-component developer. The magnetic brush may be arranged to position adjacent to the photosensitive member 1 being opposed thereto.

According to the embodiment, a developing bias in which an AC bias of Vpp=2.0 kV is combined with (superimposed on) a desired DC bias is used. The closest distance (S-D gap) between the photosensitive member 1 and the developing sleeve 41 is set to 300 μm.

For example, when a full color image is formed, each of the toner images of the respective colors formed in order on the photosensitive member 1 is transferred (primary transfer) onto the intermediate transfer member 5 at the primary transfer portion N1. While the intermediate transfer member 5 rotates desired times in a direction indicated by an arrow R2, the respective color toner images are superimposed on the intermediate transfer member 5 in order and thus the full color toner image is formed. At the primary transfer, a primary transfer bias with the polarity opposite to the proper charged polarity of the toner is applied to the primary transfer roller 51 as the primary transfer device. After that, the full color toner image on the intermediate transfer member 5 is transferred collectively onto the transfer material S at the secondary transfer portion N2 (secondary transfer). When the secondary transfer is carried out, a secondary transfer bias with the polarity opposite to the proper charged polarity of the toner is applied to secondary transfer roller 52 as the secondary transfer device.

After that, the transfer material S is transported to the fixing device 6 as a fixing unit, and is heated and pressed thereby the toner image is fixed to the surface thereof. Then, the transfer material S is discharged out of the apparatus as an output image.

After the primary transfer process, the cleaner 7 removes the residual toner on the surface of the photosensitive member 1. Then, the photosensitive member 1 is irradiated with a light emitted from the pre-exposing device 8 and is electrically initialized to be ready for the next image forming. Thus, the photosensitive member 1 is repeatedly used for the image forming. After the secondary transfer process, the intermediate transfer member 5 is also cleaned by an intermediate transfer member cleaner 9 to be ready for the next image forming. Thus, the intermediate transfer member 5 is repeatedly used for image forming.

The image forming apparatus 100 is capable of forming a single color image or a multi color image by using a desired single developing device or plural (not all) developing devices.

According to the embodiment, the image forming apparatus 100 is provided with a plurality of developing devices each using a different color toner for the single photosensitive member. By repeating the developing process and the transfer process via the single photosensitive member, the respective color toner images are superimposed on one another on the intermediate transfer member 5 as the body to be transferred with the color toner images. However, the invention is not limited to the above-described embodiment. A tandem type image forming apparatus such that a plurality of developing devices each using a different color toner is provided to a plurality of photosensitive members; and each of the respective color toner images formed on each of the plurality of the photosensitive members is superimposed on one another on the intermediate transfer members may be employed. The image forming apparatus is also not limited to an intermediate transfer type image forming apparatus using an intermediate transfer member. For example, a direct transfer type image forming apparatus, in which a transfer member support for supporting and transporting a transfer material is provided in place of the above-described intermediate transfer member; toners are directly transferred to the transfer material on the transfer member support from the photosensitive member; and the respective color toner images are superimposed on one another on the transfer material, may be employed. That is, in this case, the transfer process by the transfer device is performed only once.

[Principle of the Invention]

As described above, to obtain the same stability as the conventional while reducing the toner bearing amount using a toner the tinting strength of which is higher than that of the conventional, the γ-characteristic is required to be at least the same as the conventional art.

That is, even when a toner having a higher tinting strength is used, if the developing contrast to obtain the maximum density Dtmax is not the same, the same stability as the conventional is hardly obtained. To obtain such γ-characteristic, it is effective to set a higher absolute value for the charge amount (amount of electric charge) of the toner. The reason is as described below.

Figure 12B:
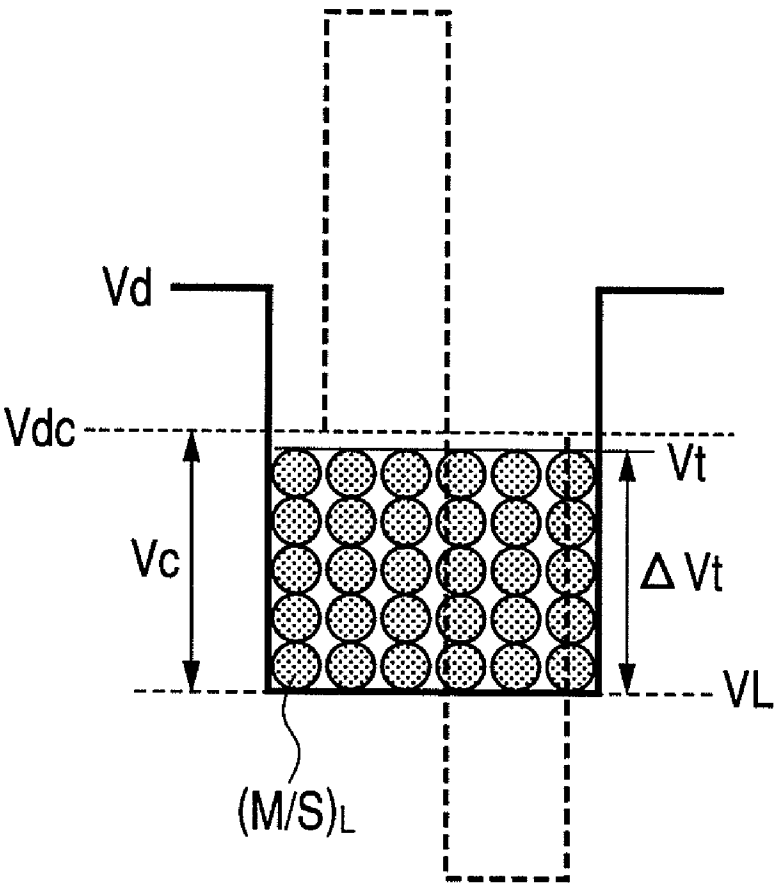
FIGS. 12A and 12B are schematic views for illustrating a relationship between the latent image electrical potential and the developing bias.
Figure 12A:
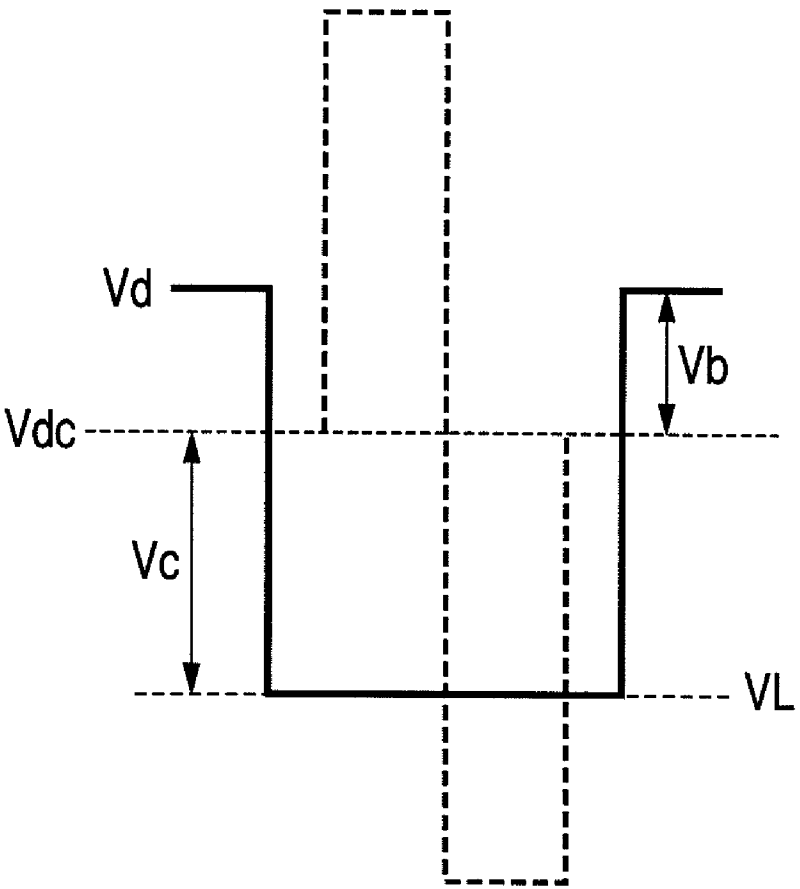

The solid line in FIG. 12A represents the latent image electrical potential on the photosensitive member, while the broken line represents the developing bias (developing bias in which an AC voltage of a rectangular waveform is superimposed on a DC voltage). A symbol Vdc represents an electrical potential of the DC-component of the developing bias, and a symbol Vd represents a charge potential of the photosensitive member (i.e., electrical potential in non-image portion). A symbol VL represents an electrical potential on the photosensitive member for obtaining the maximum toner bearing amount (i. e., maximum density Dtmax). A symbol Vc represents a difference (maximum developing contrast) between the VL and Vdc. A symbol Vb represents a difference (fog removal bias) between the Vd and Vdc.

In this embodiment, the following image exposure system is employed. That is, a photosensitive member is uniformly charged to a predetermined polarity (particularly, in this embodiment, to the negative polarity) and to a part to be developed an image is exposed with a laser beam or the like, thereby the desired electrical potential of exposed portion is obtained. As for the developing method, a reverse development method is employed. That is, the toner charged to a polarity identical to the charged polarity of the photosensitive member is adhered to the exposed portion.

In this specification, if not otherwise specified, the charge amount (amount of electric charge) of the toner is expressed with an absolute value thereof. Actually, the charge of the toner has a predetermined polarity (in this embodiment, negative polarity).

As illustrated in FIG. 12B, generally, the development is performed so that the electrical potential Vt in the outermost layer of the toner layer formed on the photosensitive member (hereinafter referred to as "outermost layer electrical potential") fills in the maximum developing contrast Vc. Here, the toner bearing amount (toner weight per unit area) of the VL electrical potential part on the photosensitive member; i.e., the maximum toner bearing amount on the photosensitive member is defined as $(M/S)_L$.

Here, an index for indicating how much the electrical potential (hereinafter, referred to as "toner layer electrical potential") ΔVt formed by the toner layer, which is expressed by the following formula: |Vt−VL|=ΔVt, fills in the developing contrast Vcont is defined as charging efficiency. That is, the charging efficiency is expressed by the formula:

charging efficiency=(ΔVt/Vc)×100. In other words, it means that when the charging efficiency is 100%, the toner layer electrical potential ΔVt fills in the developing contrast Vcont completely.

It is known that when the charging efficiency is low; i.e., when the development is terminated in a state that the toner layer electrical potential does not fully fill in the developing contrast (charge failure), various defective images are generated.

For example, generally, the distance (S-D gap) between the developing sleeve and the photosensitive member changes subtly due to a mechanical tolerance. Corresponding to this, a developing electric field also subtly changes. At this time, when the development is terminated while the toner layer electrical potential does not fully fill in the developing contrast, it may cause unevenness in the toner bearing amount due to the fluctuation of the developing electric field. As a result, the uniformity and the stability may be decreased.

Also, there may be a case that, since the toner layer electrical potential fails to fill in the developing contrast in a solid image portion located in a boundary area between a solid image (maximum density image) portion and a half-tone image portion, a contrast difference is generated with respect to the electrical potential of the half-tone image portion. Due to this, a defective image such as a blank area may be generated.

Therefore, to prevent the generation of such defective image, it is essential to ensure a state that the charging efficiency is 100%; i.e., the calculation: ΔVt=Vc is satisfied.

As a specific example, a development, which was actually performed under the following conditions, will be described.

A VL electrical potential portion (maximum density portion) formed on an organic photosensitive member (OPC photosensitive member) of 26 μm in film thickness was developed using a toner of 30 μC/g in charge amount (amount of electric charge per unit weight). The maximum developing contrast Vc at this time was controlled to be 200 V. In this case, the toner bearing amount in the VL electrical potential portion on the photosensitive member was 0.6 mg/cm$^2$, and the outermost layer electrical potential Vt in the toner layer was −199 V. More specifically, Vd=−450 V, VL=−100 V, Vdc=−300 V and ΔVt=198 V.

Figure 13B:
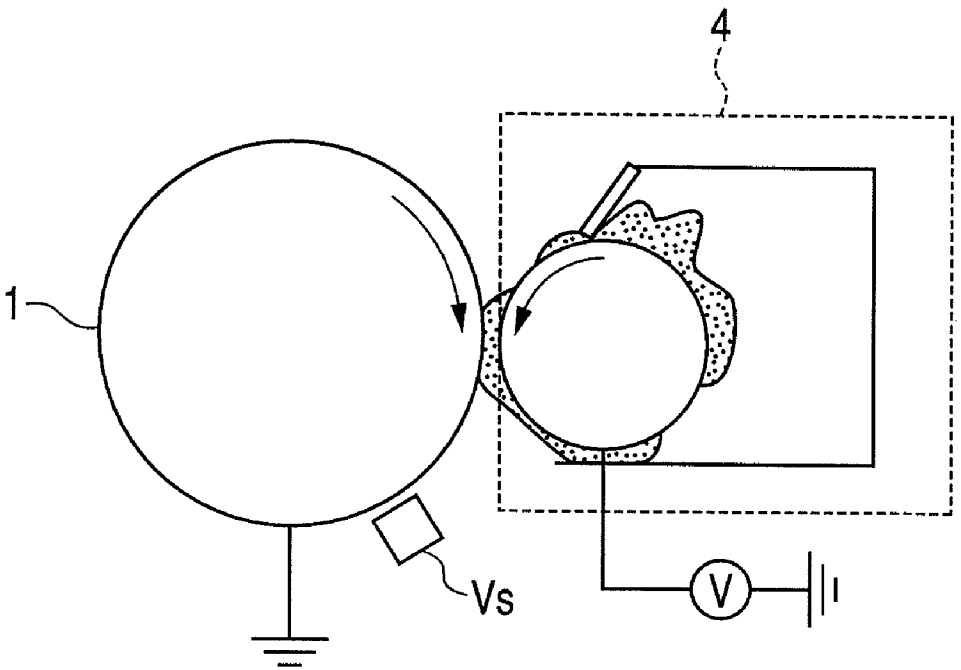
FIGS. 13A and 13B are schematic views for illustrating measurement by a surface electrometer.
Figure 13A:
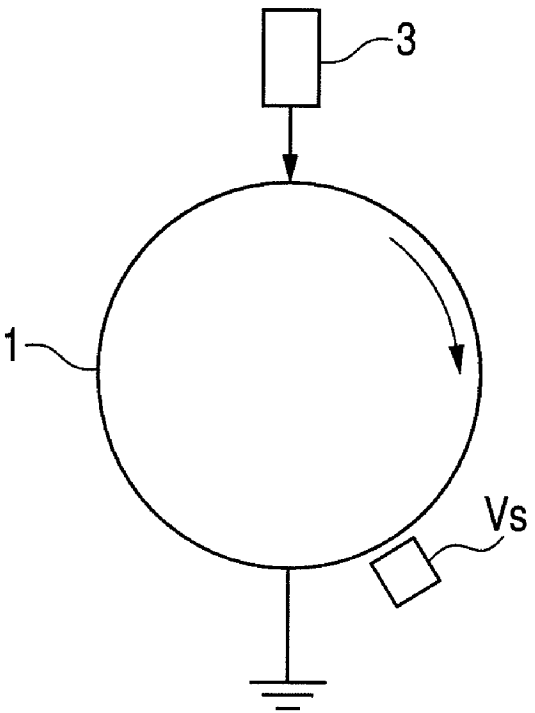
Figure 14:
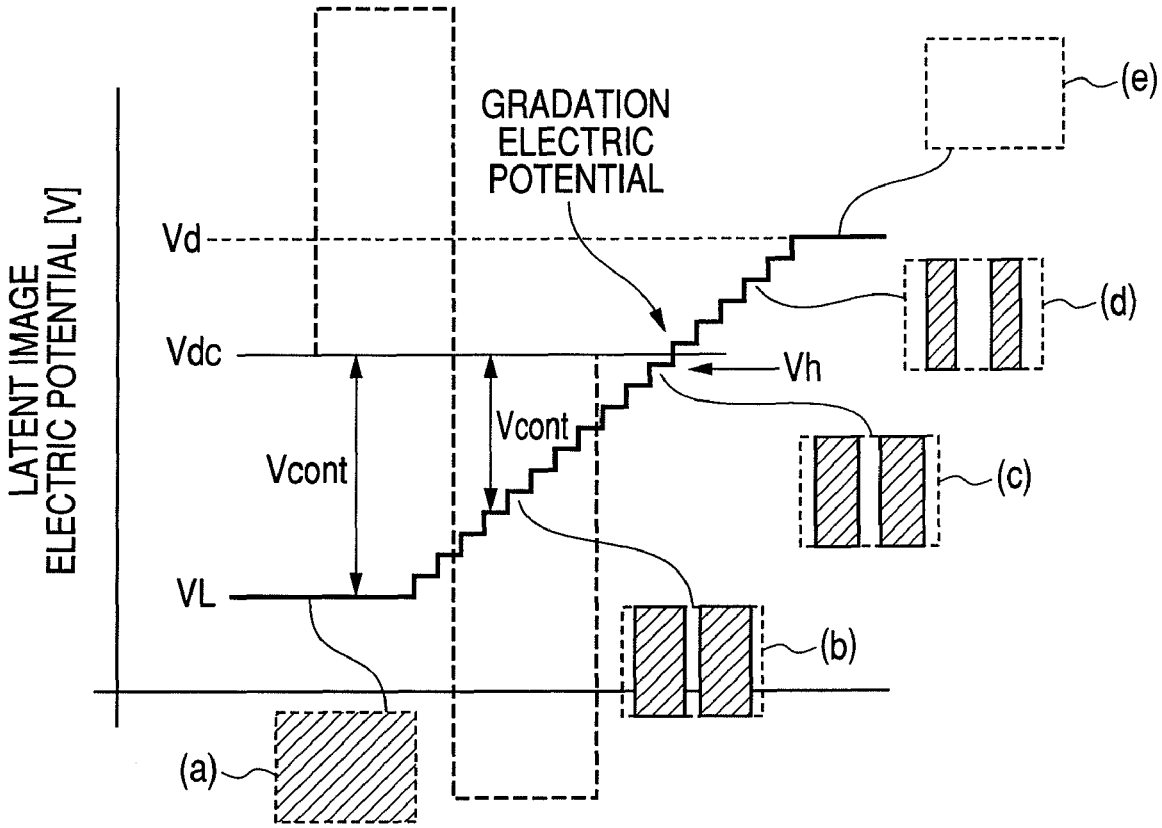
FIG. 14 is an explanatory view for illustrating latent image electrical potential digitally formed on a photosensitive member.
Figure 15A:
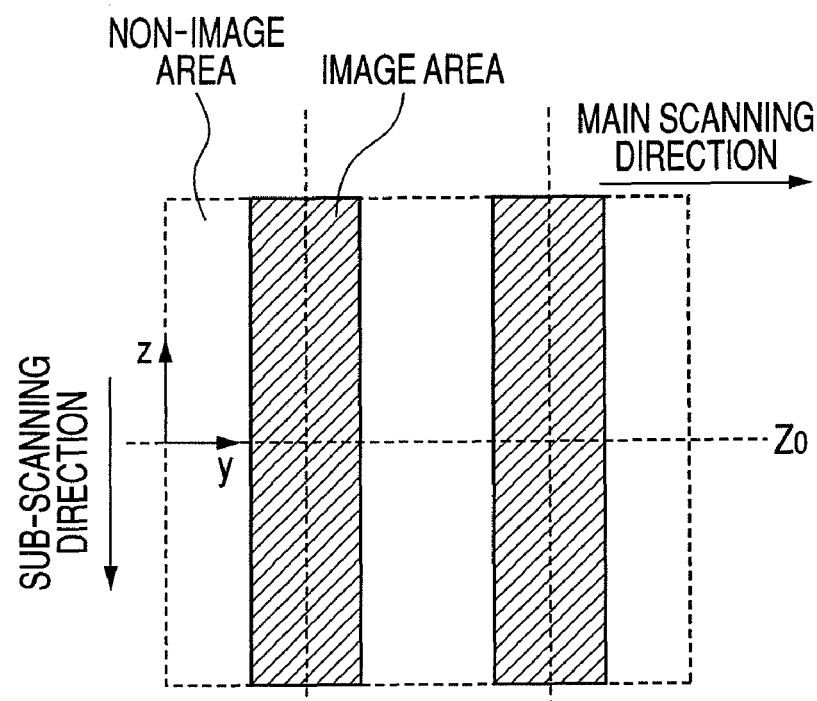
FIGS. 15A and 15B are explanatory views for illustrating latent image electrical potential digitally formed on the photosensitive member.
Figure 15B:
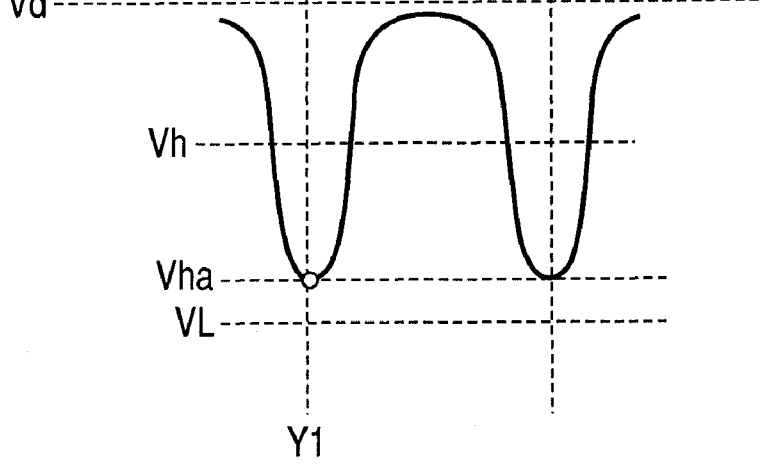
Figure 16:
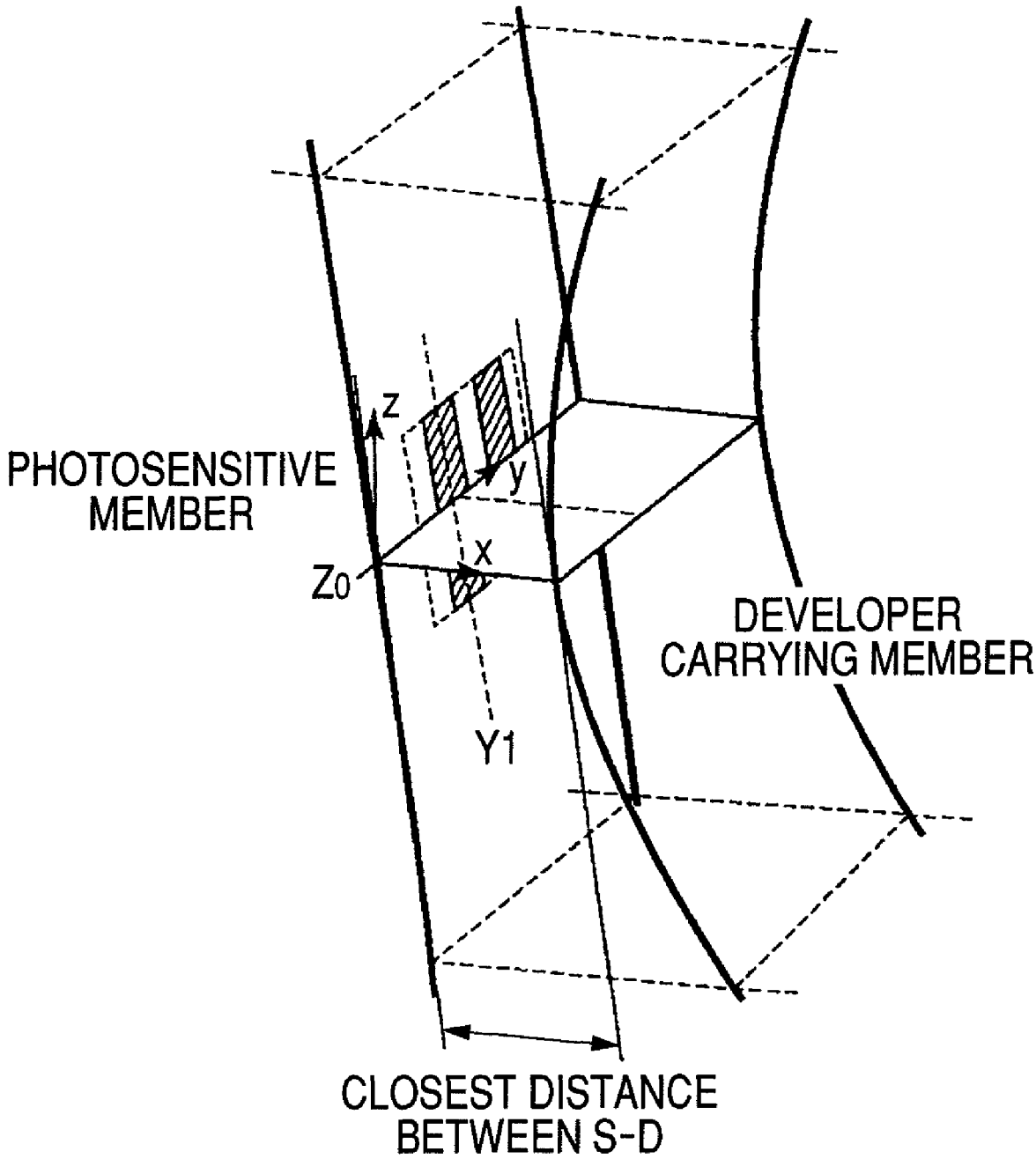
FIG. 16 is an explanatory view for illustrating a space electrical potential between the photosensitive member and a developer carrying member.
Figure 17B:
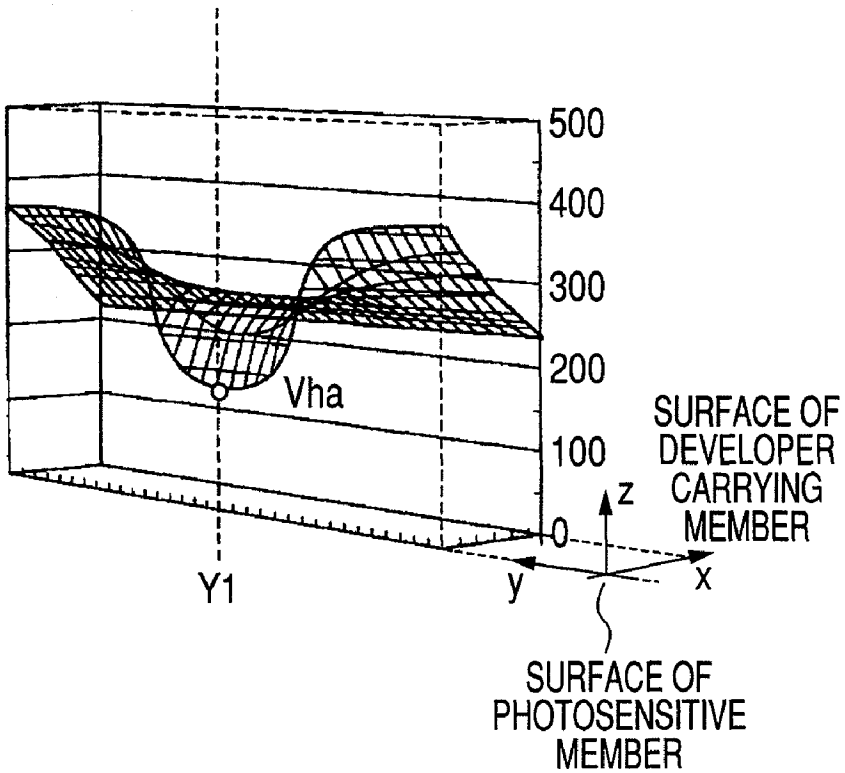
FIGS. 17A and 17B are graphs for illustrating a space electrical potential between the photosensitive member and the developer carrying member.
Figure 17A:
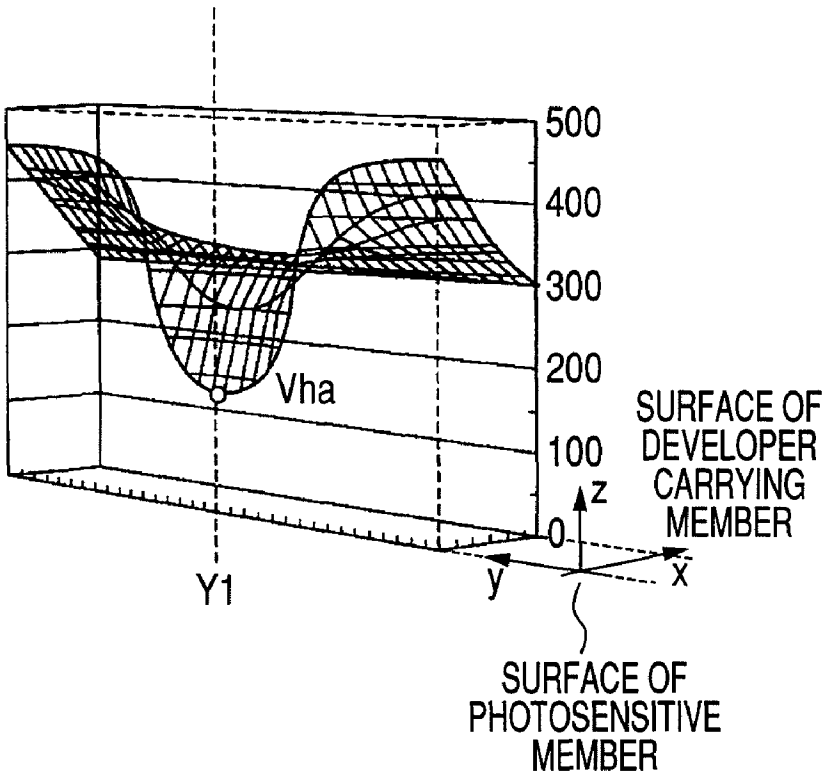
Figure 18:
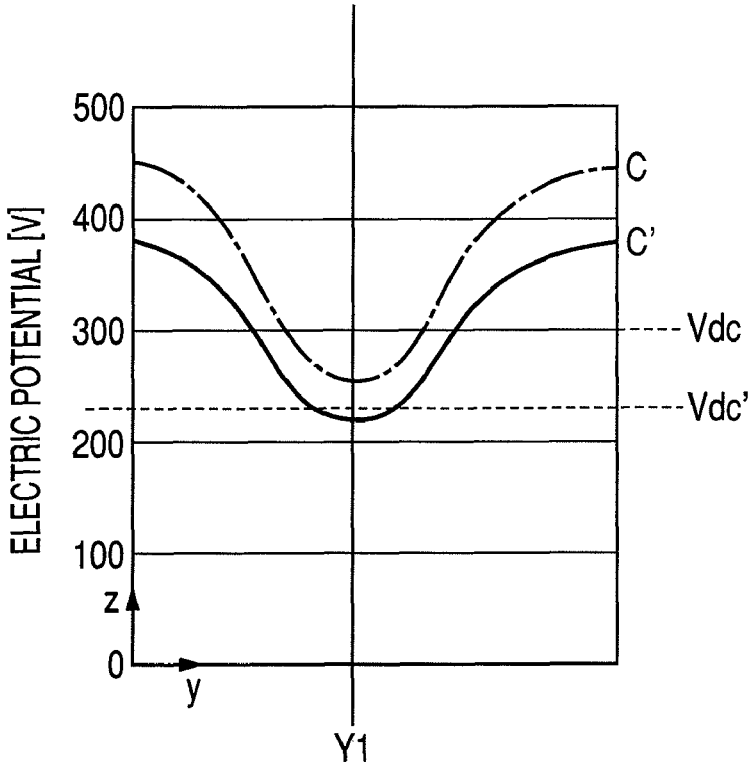
FIG. 18 is a graph for illustrating a space electrical potential between the photosensitive member and the developer carrying member.
Figure 19:
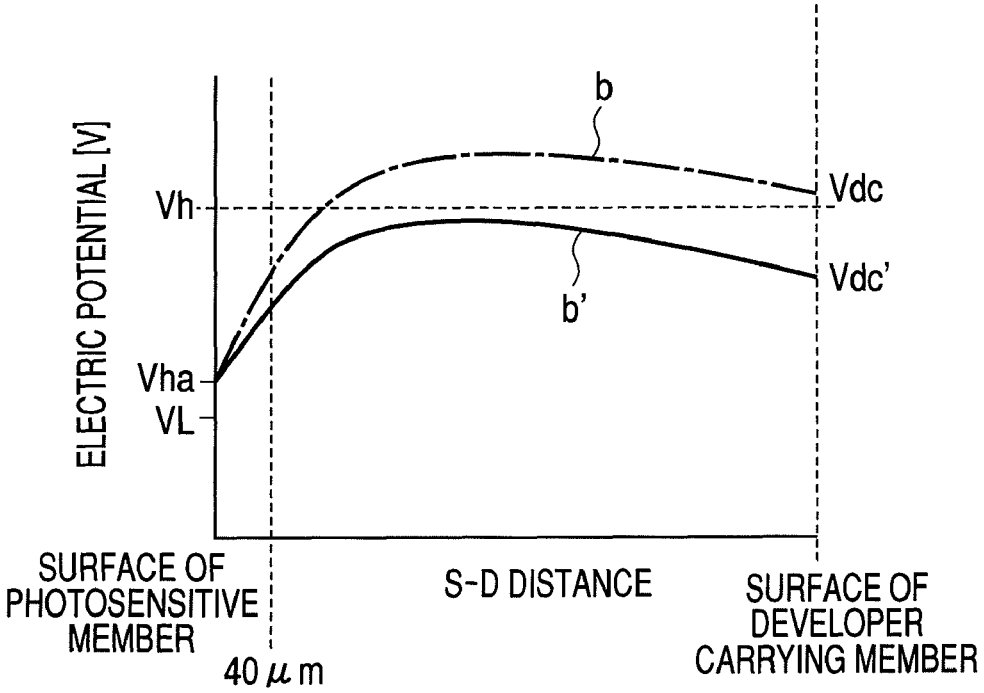
FIG. 19 is a graph for illustrating a space electrical potential between the photosensitive member and the developer carrying member.
Figure 20B:
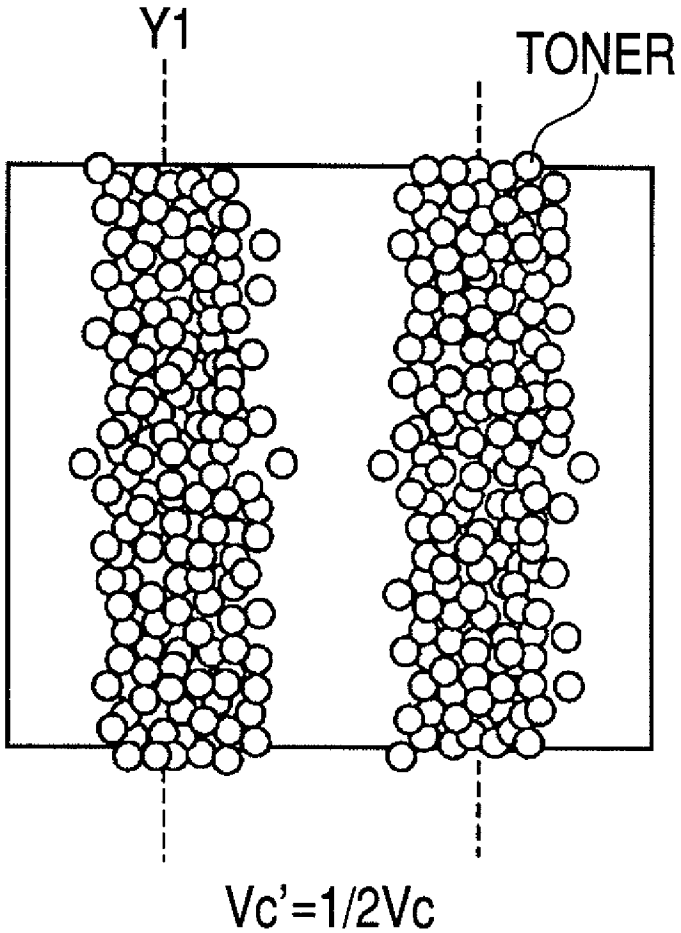
FIGS. 20A and 20B are schematic views for illustrating differences in the way of bearing toner depending on the different developing contrast.
Figure 20A:
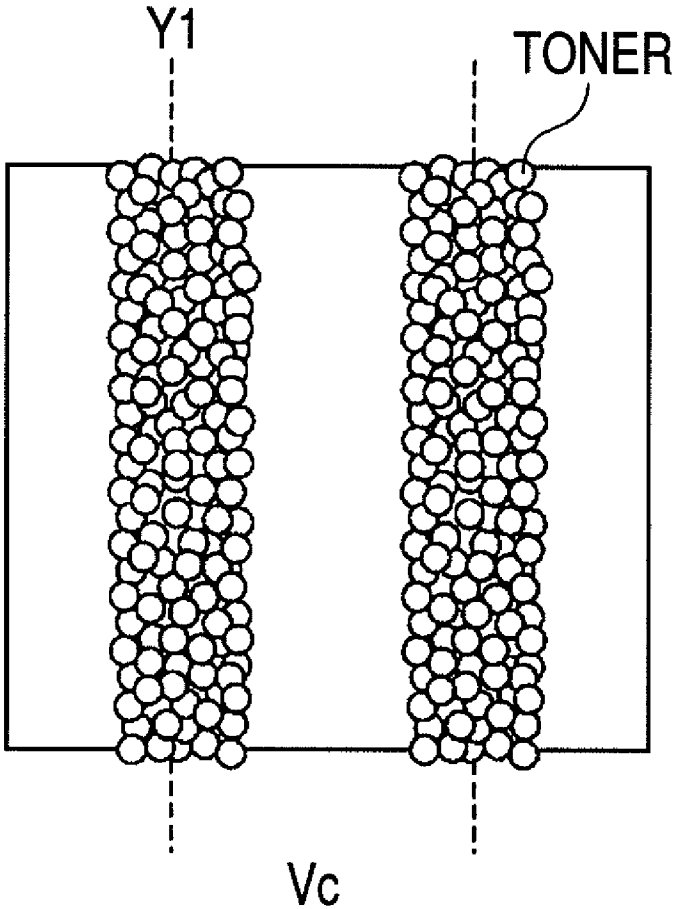

The outermost layer electrical potential Vt was measured at a position immediately after the development using a surface electrometer Vs (MODEL 347 manufactured by TREK, INC) as illustrated in FIG. 13B. ΔVt was obtained as a difference with respect to the VL electrical potential measured by the surface electrometer Vs without disposing any developing device as illustrated in FIG. 13A.

That is, in this case, the charge efficiency is expressed by the following calculation:

$$\Delta Vt/Vc \times 100 = 99\%$$

It is understood that the toner layer electrical potential substantially fills in the developing contrast.

The toner layer electrical potential ΔVt may be expressed with the following formula.

$$\Delta Vt = \left(\frac{Lt}{2\varepsilon_0\varepsilon_t} + \frac{Ld}{\varepsilon_0\varepsilon_d}\right) \times \left(\frac{M}{S}\right)_L \times \left(\frac{Q}{M}\right)_L \quad (1)$$

$(M/S)_L$: toner bearing amount in a maximum density image portion of the photosensitive member (toner weight per unit area) [mg/cm$^2$]

$(Q/M)_L$: average charge amount of toner in a maximum density image portion on the photosensitive member (toner charge amount per unit area) [μC/g]

Lt: toner layer thickness in a maximum density image portion on the photosensitive member [μm]

Ld: film thickness of photosensitive film on the photosensitive member [μm]

$\epsilon_t$: relative permittivity of the toner layer $\epsilon_d$: relative permittivity of the photosensitive member $\epsilon_0$: permittivity in vacuum In the above specific example, the actually measured height of the toner layer adhered to the VL electrical potential portion on the photosensitive member was approximately 9.2 μm. The above formula (1) was calculated while substituting the parameters with the following values. The toner layer electrical potential Δvt was resulted in 198 V.

$(M/S)_L$=0.6 mg/cm$^2$ $(Q/M))_L$=30 μC/g

Lt=9.2 μm

Ld=26 μm $\epsilon_t$=2.5

$\epsilon_d$=3.3

$\epsilon_0$=8.854×10$^{-12}$ F/m

That is, the measured ΔVt and the value calculated with the formula (1) are substantially identical to each other.

Figure 4:
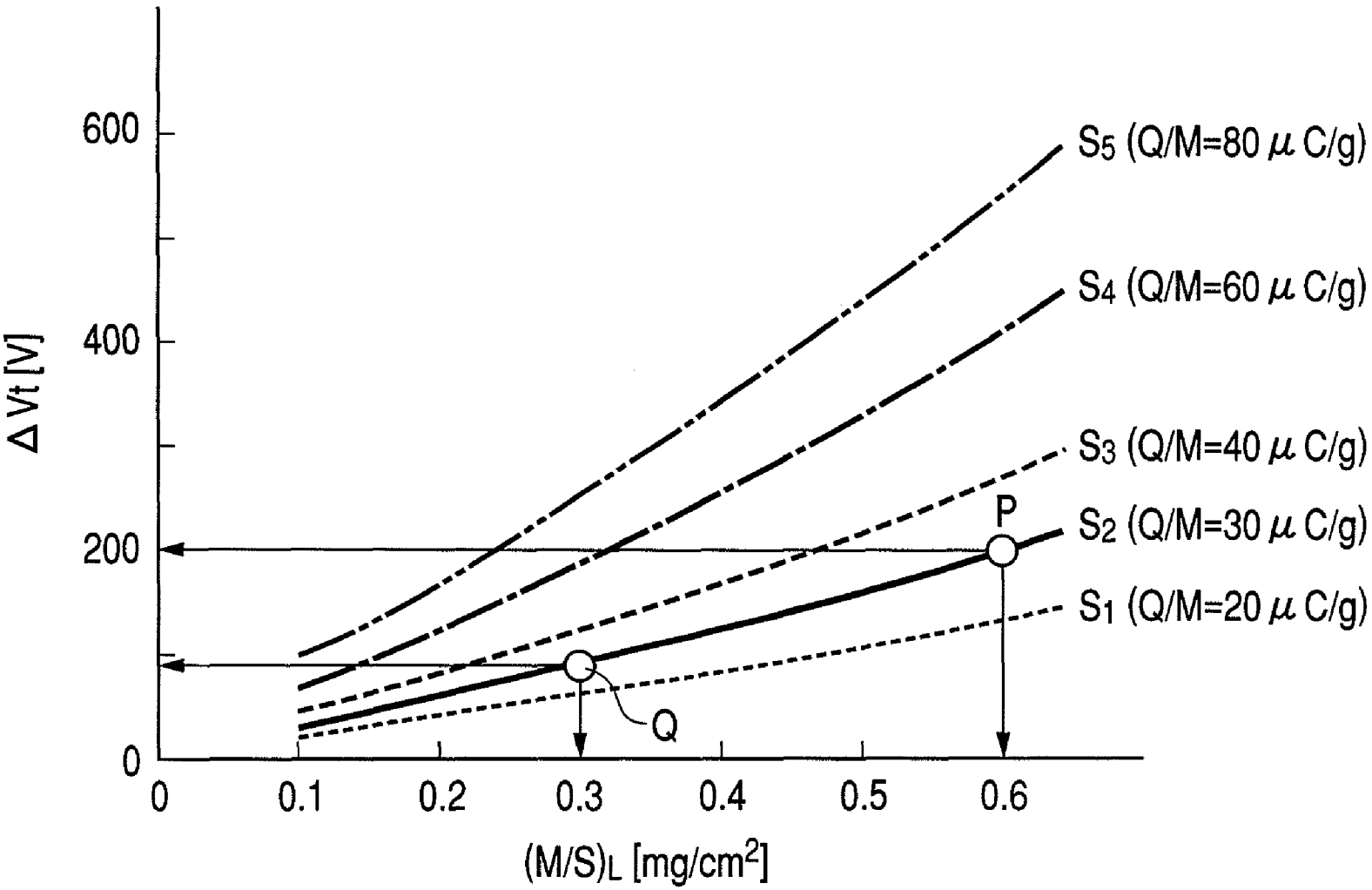
FIG. 4 is a graph for illustrating a relationship between a maximum toner bearing amount and a toner layer electrical potential depending on the toner charge amount.
Figure 5:
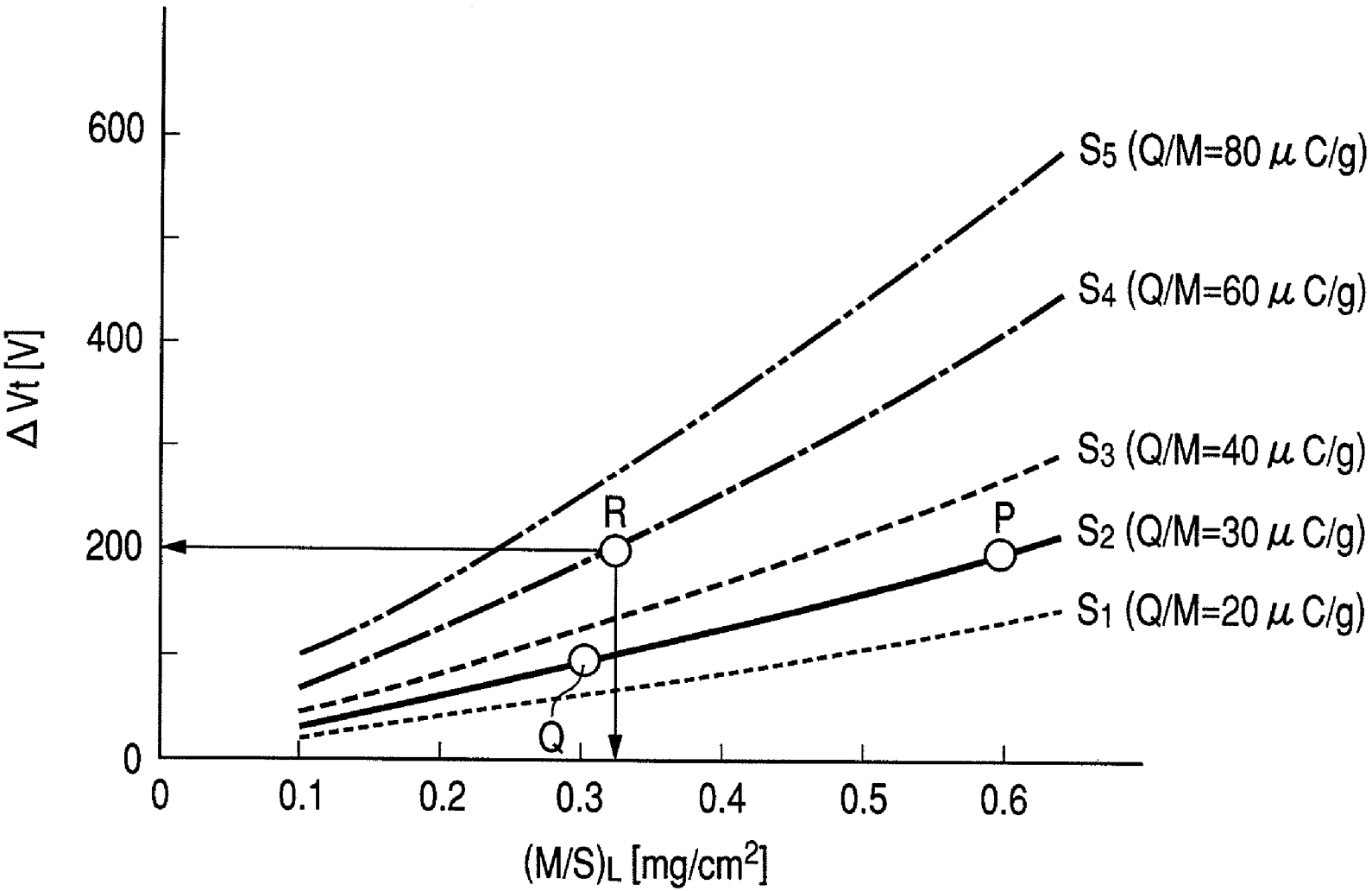
FIG. 5 is a graph for illustrating a relationship between a maximum toner bearing amount and a toner layer electrical potential depending on the toner charge amount.

FIG. 4 illustrates the dependency on the toner-charge amount Q/M of the relationship between the $(M/S)_L$ and the ΔVt obtained through an actual image output operation, (FIG. 5 is the same). For example, a line S2 of a solid line in FIG. 4 represents the Δvt when the $(M/S)_L$ was changed using a toner of 30 μC/g in charge amount. It represents that, as described above, at a point-P on the line S2; i.e., $(M/S)_L$ is 0.6 mg/cm$^2$, the toner layer electrical potential ΔVt is 198 V.

Likewise, each of the line S1, line S3, line S4 and line S5 represents the $(M/S)_L$ obtained using the following toner of 20 μC/g, 40 μC/g, 60 μC/g and 80 μC/g respectively in charge amount.

For example, at a point-Q on the line S2 in which the toner charge amount is 30 μC/g as it is, while $(M/S)_L$ is reduced to 0.3 mg/cm$^2$ a half of the conventional, the toner layer electrical potential ΔVt is 90 V.

Figure 2:
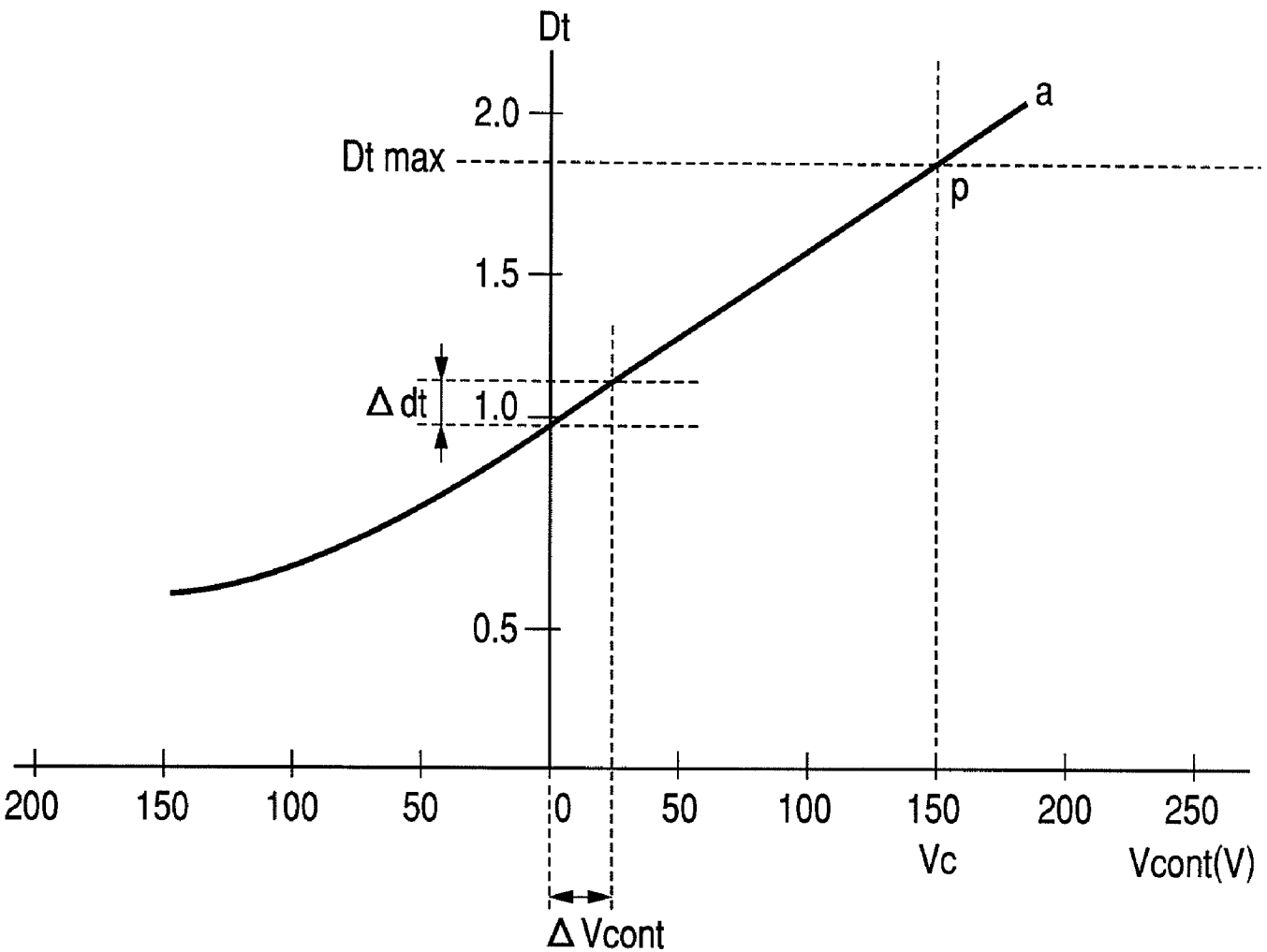
FIG. 2 is a graph illustrating an example of γ-characteristic.
Figure 3:
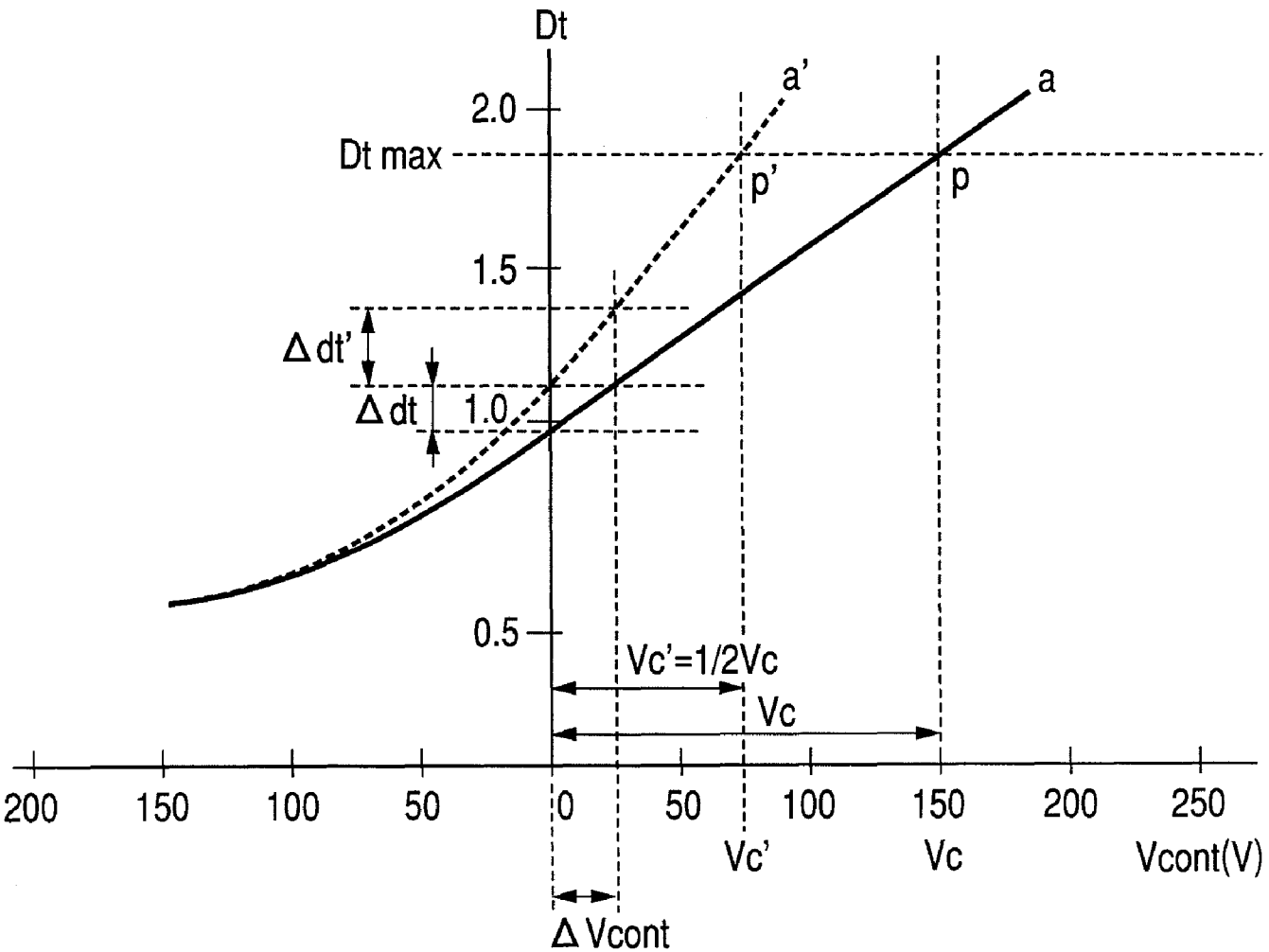
FIG. 3 is a graph for illustrating an example of γ-characteristic for showing a conventional technique to reduce the toner bearing amount by increasing tinting strength of a toner.

It should be noted that the abscissa $(M/S)_L$ in FIG. 4 represents the changes of the toner bearing amount on the photosensitive member obtained by the following manner. That is, the flat VL potential as the latent image electrical potential was changed by controlling the Vd, laser power and Vdc, thereby Vc was changed with respect to the flat VL potential. That is, the graph shown in FIG. 4 is different from a gradation curve illustrated in FIG. 2, which was obtained from the digital latent image of a desired number of lines.

As described above, when the toner charge amount is 30 μC/g as it is, and the toner bearing amount $(M/S)_L$ on the photosensitive member is set to ½, the required Vc is approximately 90 V. As a result, the inclination of the γ-characteristic is precipitous as described above.

On the other hand, referring to FIG. 5, like a line S4 of a chain line, when the toner of 60 μC/g in charge amount is used, at a point-R on a line S4 where the $(M/S)_L$ is 0.33 mg/cm$^2$, the toner layer electrical potential ΔVt is 200 V. That is, the required Vc is 200 V, and the γ-characteristic is the substantially the same as the conventional art.

Figure 6:
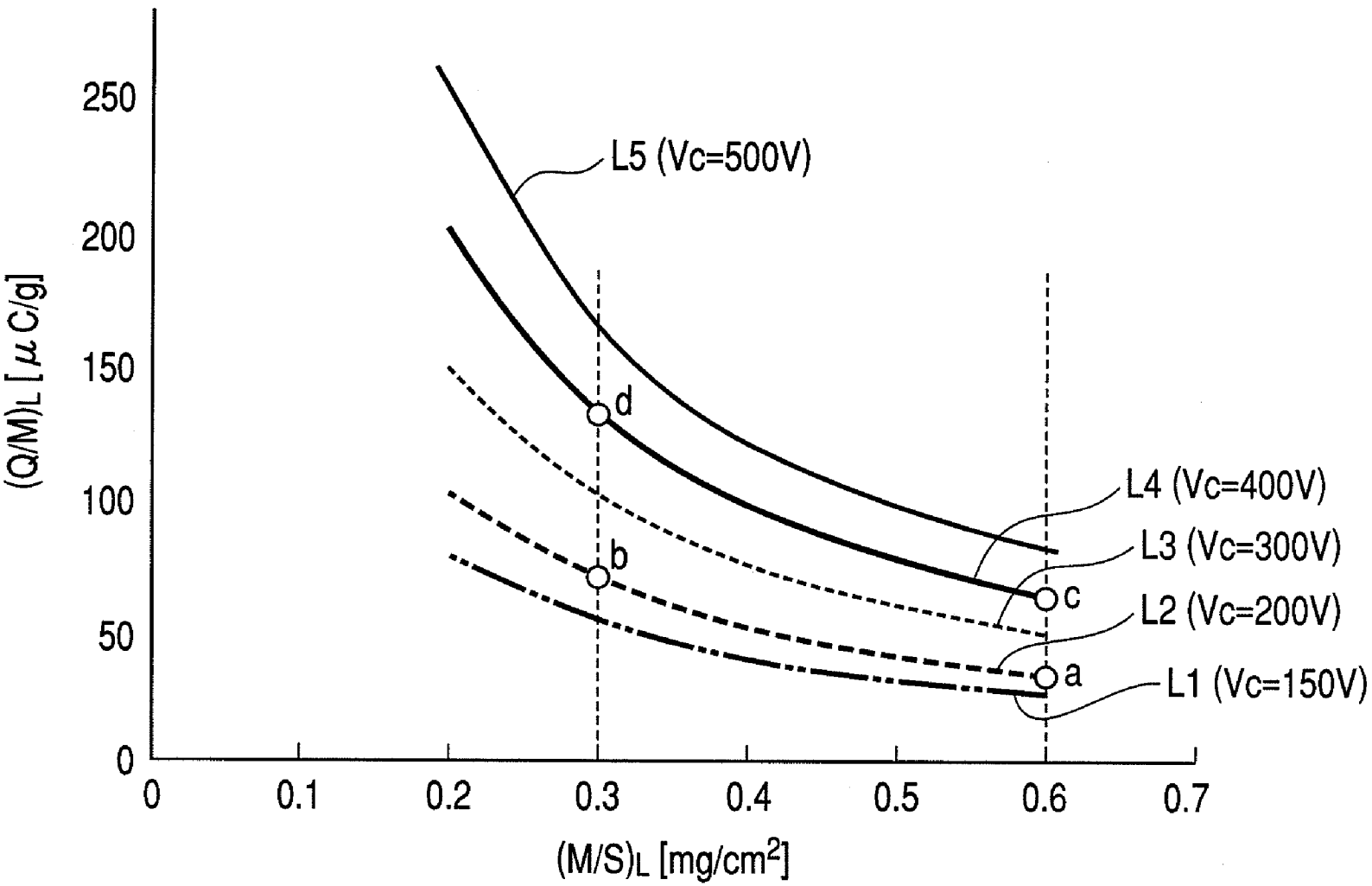
FIG. 6 is a graph for illustrating a relationship between the toner bearing amount and the toner charge amount.
Figure 7:
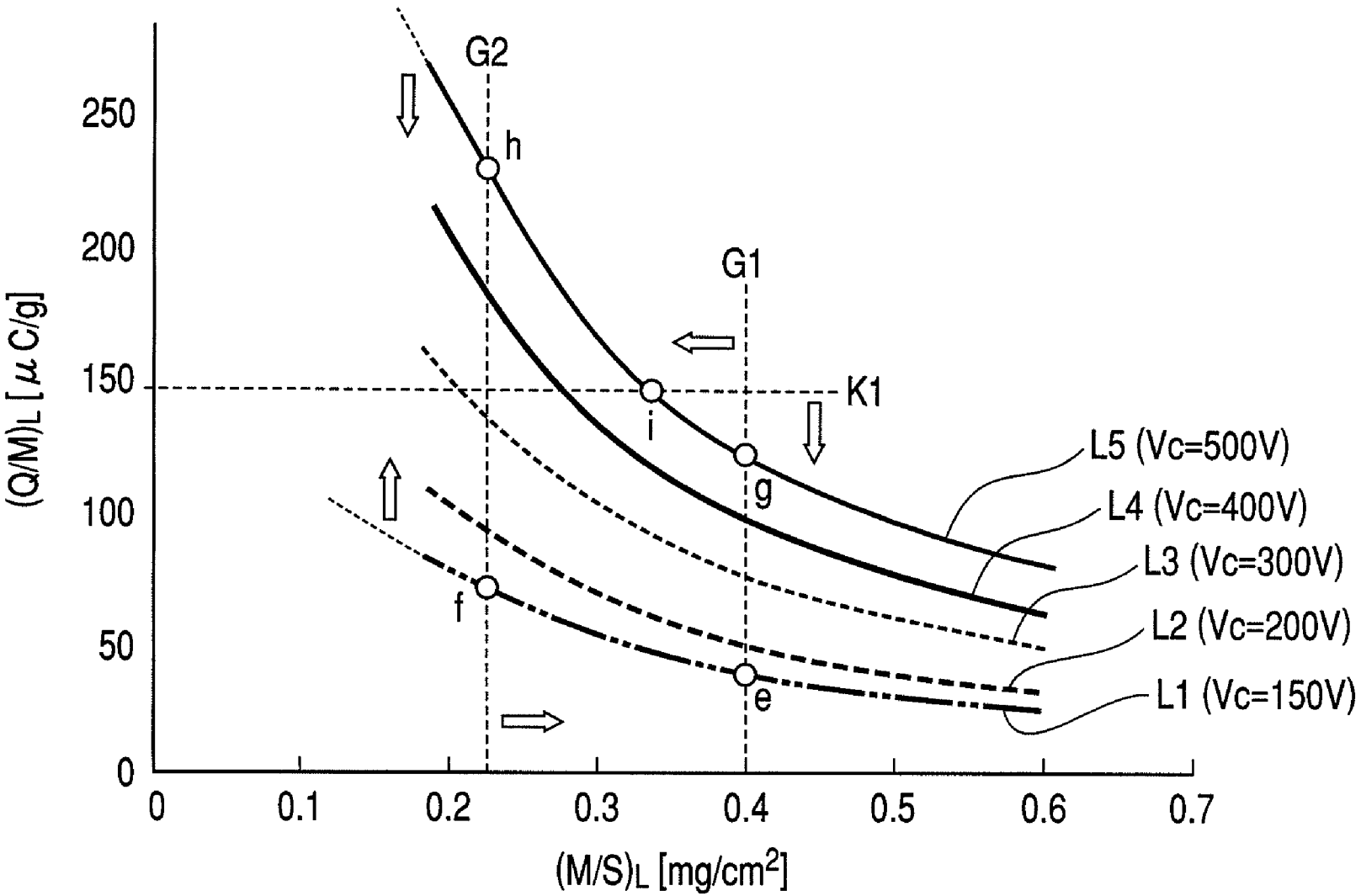
FIG. 7 is a graph for illustrating a range of the toner bearing amount and the toner charge amount according to the invention.

Further, based on FIG. 4 and FIG. 5, FIG. 6 illustrates the relationship between the $(Q/M)_L$ and $(M/S)_L$, which is required to obtain ΔVt=Vc with respect to the desired Vcont (FIG. 7 is the same).

In FIG. 6, line L1 represents ΔVt required for achieving 100% of charging efficiency at Vc=150 V; i.e., the relationship between $(Q/M)_L$ and $(M/S)_L$ required to achieve ΔVt=150 V. From the above formula (1), the line L1 fulfills the following formula.

$$L1:\left(\frac{Q}{M}\right)_L = \frac{150}{\left(\frac{Lt}{2\varepsilon_0\varepsilon_t} + \frac{Ld}{\varepsilon_0\varepsilon_d}\right)\times\left(\frac{M}{S}\right)_L}$$

Likewise, each of line L2, line L3, line L4 and line L5 represents the relationship between the $(Q/M)_L$ and $(M/S)_L$ for obtaining the ΔVt required for achieving 100% charging efficiency at Vc=200 V, Vc=300 V, Vc=400 V and Vc=500 V respectively. From the above formula (1), each of the line L2, line L3, line L4 and line L5 fulfills the following formulae.

$$L2:\left(\frac{Q}{M}\right)_L = \frac{200}{\left(\frac{Lt}{2\varepsilon_0\varepsilon_t} + \frac{Ld}{\varepsilon_0\varepsilon_d}\right)\times\left(\frac{M}{S}\right)_L}$$

$$L3:\left(\frac{Q}{M}\right)_L = \frac{300}{\left(\frac{Lt}{2\varepsilon_0\varepsilon_t} + \frac{Ld}{\varepsilon_0\varepsilon_d}\right)\times\left(\frac{M}{S}\right)_L}$$

$$L4:\left(\frac{Q}{M}\right)_L = \frac{400}{\left(\frac{Lt}{2\varepsilon_0\varepsilon_t} + \frac{Ld}{\varepsilon_0\varepsilon_d}\right)\times\left(\frac{M}{S}\right)_L}$$

$$L5:\left(\frac{Q}{M}\right)_L = \frac{500}{\left(\frac{Lt}{2\varepsilon_0\varepsilon_t} + \frac{Ld}{\varepsilon_0\varepsilon_d}\right)\times\left(\frac{M}{S}\right)_L}$$

For example, in the line L2 (in the case that Vc=200 V is required), when the $(M/S)_L$ is 0.6 mg/cm$^2$, the $(Q/M)_L$ required for obtaining ΔVt=200 V, is approximately 30.4 μC/g (point-a in FIG. 6). When the $(M/S)_L$ is 0.3 mg/cm$^2$, the $(Q/M)_L$ required for obtaining ΔVt=200V is approximately 66.5 μC/g (point-b in FIG. 6).

For example, in the line L4 (in the case that Vc=400 V is required), when the $(M/S)_L$ is 0.6 mg/cm$^2$, the $(Q/M)_L$ required for obtaining ΔVt=400 V is approximately 61 μC/g (point-c in FIG. 6). When the $(M/S)_L$ is 0.3 mg/cm$^2$, the $(Q/M)_L$ required for obtaining ΔVt=400 V is approximately 133 μC/g (point-d in FIG. 6).

That is, when the Vc for obtaining 100% of the charging efficiency and a desired γ-characteristic is determined, the $(Q/M)_L$ required for the $(M/S)_L$ is determined

[Range of $(M/S)_L$ and $(Q/M)_L$]

Referring to FIG. 7, ranges of various characteristics required for reducing the toner bearing amount will be described.

A. Range of $(Q/M)_L$

First of all, a range of the $(Q/M)_L$ will be described.

As described above, to ensure image stability and image quality, the inclination of the γ-characteristic is preferred to be the same as or more moderate than that of the γ-characteristic for obtaining the maximum density ⊃ tmax at Vc=150 V.

Therefore, in FIG. 7, the $(Q/M)_L$ can be set to a range above the line L1 indicating the relationship between the $(M/S)_L$ and $(Q/M)_L$ required to obtain ΔVt=150 V.

Needless to say, the more moderate the inclination of the γ-characteristic; i.e., the larger Vc for obtaining the maximum density, the more effectively stability and contrast can be obtained. However, the inclination of the γ-characteristic has a limit depending on the other processing conditions (charge process conditions or the like) and a limit value of the toner-charge amount.

For example, referring to FIG. 12, when the Vb potential is about 150 V and the VL potential is about 100 V, the charge potential Vd on the photosensitive member requires to be set to 750 V or more to obtain Vc=500 V or more. However, an extremely large current is required to uniformly charge the surface of the photosensitive member with 750 V or more using a charging unit such as a corona charger. Therefore, a practical range is Vc=500 V or less. That is, the $(Q/M)_L$ can be set to a range of the line L5 or below in FIG. 7, which represents the relationship between the $(M/S)_L$ and $(Q/M)_L$ required to obtain ΔVt=500 V.

In other words, taking practical value into consideration, the maximum developing contrast Vc can be within a range of 150 V≦Vc≦500 V.

There is a limit value as the charge amount of the toner. It is known that, in a dry developing, the actually available toner charge amount is about 150 μC/g. That is, when the toner charge amount exceeds 150 μC/g, the toner is hardly released from the carrier. As a result, the development itself may be difficult to perform. Further, since charge amount at the carrier side becomes higher, the carrier may adhere to the photosensitive member. Therefore, the $(Q/M)_L$ can be limited to a range of the line K1 or below representing $(Q/M)_L$=150 μC/g in FIG. 7.

B. Range of $(M/S)_L$

Next, a range of the $(M/S)_L$ will be described below.

Generally, the electrophotographic full color image forming apparatus is provided with the following process. That is, total amount of the toner in a part forming an image with multi color is controlled to be 2.0 to 2.5 times or less as much as a maximum toner bearing amount per single color. That is, in the case that the maximum toner bearing amount per single color is 0.6 mg/cm$^2$ on the photosensitive member, and approximately 0.56 mg/cm$^2$ on the paper, when the total amount of the toner in a part to be formed with multi color is 2.5 times as much as the maximum toner bearing amount per single color, the upper limit value thereof on the paper is calculated by the following calculation:

$$0.56\times2.5=1.4\ \text{mg/cm}^2.$$

The toner of this amount is fused and fixed onto the paper by the fixing device. The above amount of the toner was actually fixed onto paper using, for example, Imagepress C1 fixing device manufactured by Canon Inc. The toner layer height after fixation was approximately 13 μm. It was found that when the toner layer height was approximately 13 μm, a large toner relief was caused between the image portion and the non-image portion.

Figure 11:
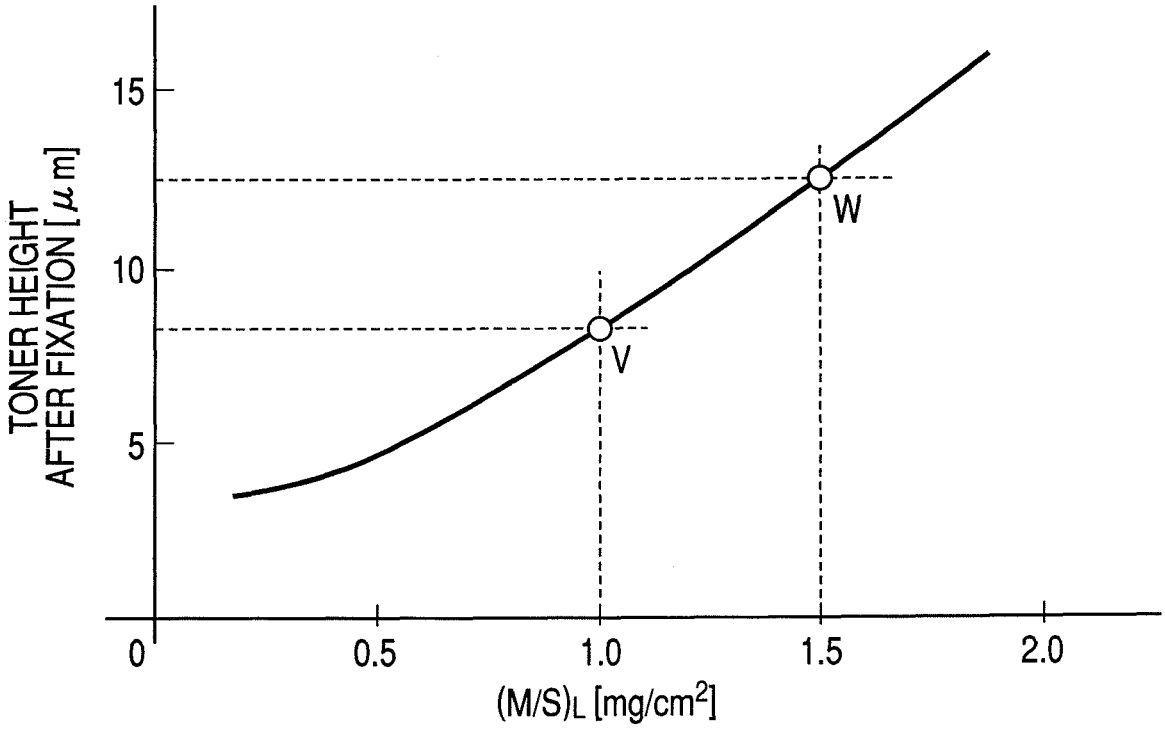
FIG. 11 is a graph for illustrating the toner bearing amount and toner height after fixation.

FIG. 11 illustrates the relationship between the total amount of the toner and the toner height after fixation (i.e., toner relief). When the maximum toner bearing amount per single color on the photosensitive member is reduced to 0.4 mg/cm$^2$; and to approximately 0.37 mg/cm$^2$ on the paper, the total amount of the toner on the paper can be reduced to approximately 1 mg/cm$^2$ based on the following calculation:

$$0.37\times2.5=0.93\ \text{mg/cm}^2.$$

It was found that the toner layer height after fixation was approximately 8 μm as illustrated in FIG. 11. Further, it was found that when the toner layer height becomes approximately 8 μm, visual sensitivity on the toner relief to the non-image portion is reduced and the toner relief becomes inconspicuous.

Therefore, the maximum toner bearing amount per single color can be set to 0.4 mg/cm$^2$ or less on the photosensitive member; and to 0.37 mg/cm$^2$ or less on the paper. That is, the $(M/S)_L$ can be limited to a range of the line G1 or below in FIG. 7, which indicates that the $(M/S)_L$=0.4 mg/cm$^2$.

Defining an intersection of the line L1 with the line G1 indicating the upper limit of the $(M/S)_L$ in FIG. 7 as point-e; and defining an intersection of the line L5 with the line G1 indicating the upper limit of the $(M/S)_L$ in FIG. 7 as point-g. The values of $(M/S)_L$ and $(Q/M)_L$ at the point-e and the point-g are as follows.

point-e: $(M/S)_L$=0.4 mg/cm$^2$, $(Q/M)_L$=36 μC/g point-g: $(M/S)_L$=0.4 mg/cm$^2$, $(Q/M)_L$=121 μC/g There is further a theoretical limit value (lower limit value) in the toner bearing amount for obtaining a desired maximum density corresponding to the particle diameter of the toner. That is, to obtain a desired maximum density with a smaller toner bearing amount, it is ideal that the fixed toner completely fills in the entire of the transfer material such as a paper. To achieve the above, it is known that the toner bearing amount of 0.22 mg/cm$^2$ or more on the photosensitive member, and approximately 0.20 mg/cm$^2$ or more on the paper are required. The reason of this will be described below with reference to FIGS. 24A, 24B, 24C and 24⊃.

Figure 24A:
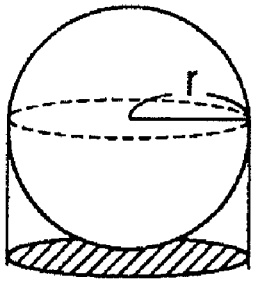
FIGS. 24A, 24B, 24C, and 24D are schematic views for illustrating a range of the toner bearing amount.
Figure 24B:
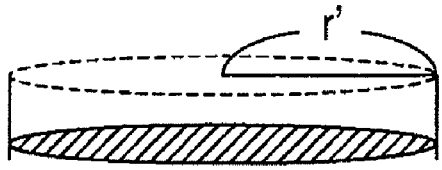
Figure 24C:
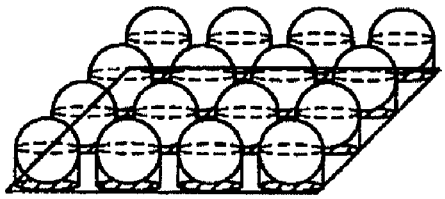
Figure 24D:
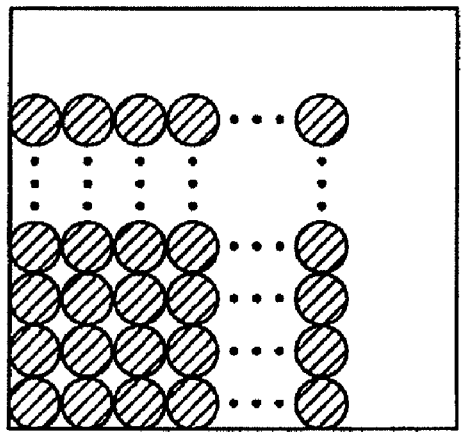

Assuming now that the particle diameter of the toner is 5 μm, a projected area of the toner is approximately 19.6 μm$^2$ (radius r=2.5 μm) (refer to FIG. 24A). Now the case where the toner is ideally flattened to 2 μm in height by fixing process is considered. In this case, the area of the toner becomes approximately 32.7 μm$^2$ (radius r'=32.3 μm) (refer to FIG. 24B). That is, the area is expanded to approximately 1.6 times as wide as the original area per particle of the toner.

When the toner of 0.2 mg/cm$^2$ of the toner bearing amount is spread over a unit area (refer to FIG. 24C), the ratio of the projected area occupied by the toner in the unit area is approximately 57% of the whole. Further, the case where the toner is entirely flattened ideally is considered (refer to FIG. 24D). In this case, the area per particle of the toner is expanded to approximately 1.6 times as wide as the original area. Therefore, the area ratio becomes approximately 1 as obtained by the following calculation: 0.57×1.67=0.95. Accordingly, the toner can fill in substantially 100% of the unit area.

That is, when the toner bearing amount on the paper is smaller than 0.2 mg/cm$^2$, even when an ideal fixing is achieved, a space is left among the flattened particles of the toner. As a result, a part of the transfer material such as a base paper is exposed, and thereby the desired maximum density cannot be obtained efficiently.

Therefore, when the particle diameter of the toner is 5 μm or greater, the toner bearing amount on the photosensitive member is desirable to be 0.22 mg/cm$^2$ or more; 0.20 mg/cm$^2$ or more on the paper. That is, the $(M/S)_L$ is desirable to be the line G2 or more in FIG. 7, which indicates $(M/S)_L$=0.22 mg/cm$^2$.

An intersection of the line L1 with the line G2 indicating the lower limit of the $(M/S)_L$ in FIG. 7 is defined as a point-f. Also, an intersection of the line L5 with the line G2 indicating the lower limit of the $(M/S)_L$ in FIG. 7 is defined as a point-h. Further, an intersection of the line L5 with the line K1 indicating the upper limit of the $(Q/M)_L$ in FIG. 7 is defined as a point-i. The values of $(M/S)_L$ and $(Q/M)_L$ at the point-f, point-h and point-i are as follows.

point-f: $(M/S)_L$=0.22 mg/cm$^2$, $(Q/M)_L$=70.1 μC/g point-h: $(M/S)_L$=0.22 mg/cm$^2$, $(Q/M)_L$=234 μC/g point-i: $(M/S)_L$=0.33 mg/cm$^2$, $(Q/M)_L$=150 μC/g (calculated value)

Here, the particle diameter of the toner is acceptable to be 5.0 μm or more. When the particle diameter of the toner is less than 5.0 μm, the developability may decrease. On the other hand, the particle diameter of the toner is acceptable to be 7.5 μm or less. When the particle diameter of the toner is larger than 7.5 μm, the image portion which requires a high resolution such as the thin line reproducibility of image may be degraded.

C. Relational expression of a range between the $(M/S)_L$ and the $(Q/M)_L$

As described above, the range of the $(M/S)_L$ and the $(Q/M)_L$ for obtaining the γ-characteristic that can reduce the toner bearing amount and ensure the stability is the range indicated with slant lines in FIG. 1. FIG. 1 illustrates the same relationship between the $(M/S)_L$ and the $(Q/M)_L$ as those in FIG. 6 and FIG. 7. The range indicated by the slant lines in FIG. 1 can be expressed as follows.

The $(M/S)_L$ satisfies the following calculation:

$$0.22\ \text{mg/cm}^2 \leqq (M/S)_L \leqq 0.4\ \text{mg/cm}^2.$$

From the above formula (1), the following formula is derived.

$$\left(\frac{Q}{M}\right)_L = \frac{\Delta Vt}{\left(\frac{Lt}{2\varepsilon_0\varepsilon_t} + \frac{Ld}{\varepsilon_0\varepsilon_d}\right)\times\left(\frac{M}{S}\right)_L} \qquad (1)\text{-}2$$

To achieve 100% of the charging efficiency the following calculation holds:

$$\Delta Vt = Vc \qquad (1)\text{-}3.$$

Taking a practical value into consideration, the maximum developing contrast Vc is desirable to be within the following range:

$$150\ \text{V} \leqq Vc \leqq 500\ \text{V} \qquad (1)\text{-}4$$

The $(M/S)_L$ is within the above range, and the $(Q/M)_L$ with respect to each $(M/S)_L$ satisfies the following formulae (1)-5 and (2).

From the formulae (1)-2 and (1)-3:

$$\left(\frac{Q}{M}\right)_L = \frac{Vc}{\left(\frac{Lt}{2\varepsilon_0\varepsilon_t} + \frac{Ld}{\varepsilon_0\varepsilon_d}\right)\times\left(\frac{M}{S}\right)_L} \quad (1)\text{-}5$$

From the formulae (1)-4 and (1)-5, $$\frac{150}{\left(\frac{Lt}{2\varepsilon_0\varepsilon_t} + \frac{Ld}{\varepsilon_0\varepsilon_d}\right)\times\left(\frac{M}{S}\right)_L} \leq \left(\frac{Q}{M}\right)_L \leq \frac{500}{\left(\frac{Lt}{2\varepsilon_0\varepsilon_t} + \frac{Ld}{\varepsilon_0\varepsilon_d}\right)\times\left(\frac{M}{S}\right)_L} \quad (2)$$

Further, the $(Q/M)_L$ satisfies the following formula: $(Q/M)_L \leqq 150\ \mu C/g$ . . . (2)-2

[Toner Bearing Amount and Density After Fixation]

Next, the tinting strength of the toner, toner bearing amount and relationship with $(Q/M)_L$ will be described.

A. Toner

Preferable modes of the toner applicable to the invention include a toner of a first mode and a toner of a second mode described below.

The toner of the first mode, which is used for a two-component developer and a supplemental developer, is a toner composed of toner particles containing a resin including a polyester unit as a principal component and a coloring agent. The wording "polyester unit" means a part derived from polyester; while the wording "resin including a polyester unit as a principal component" means a resin in which many of repeated units constituting the resin are the repeated units having an ester bond, which will be described later in detail.

The polyester unit is formed by the polycondensation of an ester-based monomer. The ester-based monomer includes polyalcohol compounds, and carboxylic acid compounds such as polycarboxylic acid, polycarboxylate anhydride, or polycarboxylate ester having two or more carboxyl groups.

As of polyhydric alcohol compounds, the dihydric alcohol component includes: an alkylene oxide additive of bisphenol A, such as polyoxypropylene(2,2)-2,2-bis(4-hydroxyphenyl) propane, polyoxypropylene(3,3)-2,2-bis(4-hydroxyphenyl) propane, polyoxyethylene(2,0)-2,2-bis(4-hydropxyphenyl) propane, polyoxypropylene(2,0)-polyoxyethylene(2,0)-2,2-bis(4-hydroxyphenyl)propane, and polyoxypropylene (6)-2,2-bis(4-hydroxyphenyl)propane; ethylene glycol; diethylene glycol; triethylene glycol; 1,2-propylene glycol; 1,3-propylene glycol; 1,4-butane diol; neopenthyl glycol; 1,4-butene diol; 1,5-pentane diol; 1,6-hexane diol; 1,4-cyclohexane dimethanol; dipropylene glycol; polyethylene glycol; polypropylene glycol; polytetramethylene glycol; bisphenol A, and hydrogenated bisphenol A.

As of polyhydric alcohol compounds, the tri- and higher alcohol component includes sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methylpropane triol, 2-methyl-1,2,4-butane triol, trimethylol ethane, trimethylol propane, and 1,3,5-trihydroxymethyl benzene.

Applicable carboxylic acid component structuring the polyester unit includes: aromatic dicarboxylic acid such as phthalic acid, isophthalic acid, and terephthalic acid, and an anhydride thereof; alkyl dicarboxylic acid such as succinic acid, adipic acid, sebacic acid, and azeraic acid, and an anhydride thereof; succinic acid substituted by C6-C12 alkyl group, and an anhydride thereof; and unsaturated dicarboxylic acid such as fumaric acid, maleic acid, and citraconic acid, and an anhydride thereof.

A preferable resin containing the polyester unit, existing in the toner particle of the first mode includes a polyester resin which is obtained by polycondensation of a bisphenol-derivative having a structure represented by the following chemical formula, as the alcoholic component, with a carboxylic acid component composed of a di- or higher carboxylic acid or an anhydride thereof, or a lower alkyl ester thereof, (such as fumaric acid, maleic acid, maleic acid anhydride, phthalic acid, terephthalic acid, dodecenyl succinic acid, trimelitic acid, and pyrromelitic acid). The polyester resin has good charging characteristic. The charging characteristic of the polyester resin further effectively functions when the resin is used as a resin existing in a color toner in a two-component developer.

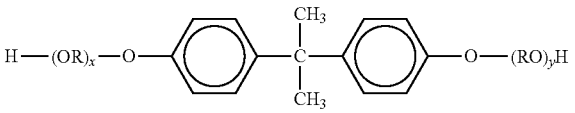

[where R is one or more of ethylene group and propylene group, x and y are each an integer of 1 or larger, and an average value of (x+y) is in a range from 2 to 10.]

A preferable resin having the polyester unit, existing in the toner particle of the first mode, includes a polyester resin having a crosslinking position. The polyester resin having crosslinking position is prepared by polycondensation of a polyhydric alcohol with a carboxylic acid component which contains tri- or higher carboxylic acid. Examples of the tri- or higher carboxylic acid are 1,2,4-benzene tricarboxylic acid, 1,2,5-benzene tricarboxylic acid, 1,2,4-naphthalene tricarboxylic acid, 2,5,7-naphthalene tricarboxylic acid, 1,2,4,5-benzene tetracarboxylic acid, an anhydride thereof, and an ester thereof. The content of the tri- or higher carboxylic acid component in the ester-based monomer being polycondensated is preferably in a range from 0.1 to 1.9% by mole based on the total monomer quantity.

Examples of preferred resin having the polyester unit in the toner particle of the first mode are: (a) a hybrid resin having the polyester unit and a vinyl-based polymer unit; (b) a mixture of the hybrid resin with the vinyl-based polymer; (c) a mixture of the polyester resin and the vinyl-based polymer; (d) a mixture of the hybrid resin and the polyester resin; and (e) a mixture of the polyester resin, the hybrid resin, and the vinyl-based polymer.

The hybrid resin is prepared by binding the polyester unit with the vinyl-based polymer by the ester interchange reaction, which vinyl-based polymer is prepared by polymerization of a monomer component having a carboxylic acid ester group such as acrylic acid ester. The hybrid resin includes a graft copolymer or a block copolymer, composed of the vinyl-based polymer as the main polymer and the polyester unit as the branched polymer.

The vinyl-based polymer unit indicates the portion originated from the vinyl-based polymer. The vinyl-based polymer unit or the vinyl-based polymer is prepared by polymerization of a vinyl-based monomer which is described later.

The toner of the second mode in the two-component developer and the supplemental developer is a toner having the toner particles prepared by direct polymerization or in aqueous medium. The toner according to the second embodiment may be prepared by direct polymerization or may be prepared by forming emulsified fine particles in advance, followed by coagulating thereof with a coloring agent and a coagulator. The toner having the toner particles prepared by the latter method is also referred to as the "toner obtained in aqueous medium" or "toner obtained by emulsion coagulation method".

The toner according to the second mode is obtained by direct polymerization method or emulsion coagulation method. The toner of the second embodiment preferably has toner particles having a resin mainly composed of a vinyl-based resin. The vinyl-based resin which is the main component of the toner particles is prepared by the polymerization of vinyl-based monomer. The vinyl-based monomer includes a styrene-based monomer, an acryl-based monomer, a methacryl-based monomer, an ethylene unsaturated mono-olefinic monomer, a vinylester monomer, a vinylether monomer, a vinylketone monomer, an N-vinyl compound monomer, and other vinyl monomer.

The styrene-based monomer includes styrene, o-methyl styrene, m-methyl styrene, p-methyl styrene, p-methoxy styrene, p-phenyl styrene, p-chlor styrene, 3,4-dichlor styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, and p-n-dodecyl styrene.

The acryl-based monomer includes: acrylic acid ester such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, dimethylaminoethyl acrylate, and phenyl acrylate; acrylic acid; and acrylic acid amide.

The methacryl-based monomer includes: methacrylic acid ester such as ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; methacrylic acid; and methacrylic acid amide.

The monomer of ethylene unsaturated mono-olefin includes ethylene, propylene, butylenes, and isobutylene.

The monomer of vinyl ester includes vinyl acetate, vinyl propionate, and vinyl benzoate.

The monomer of vinyl ether includes vinyl methylether, vinyl ethylether, and vinyl isobutylether.

The monomer of vinyl ketone includes vinyl methyl ketone, vinyl hexyl ketone, and methyl isopropenyl ketone.

The monomer of N-vinyl compound includes N-vinylpyrrole, N-vinylcarbazol, N-vinylindol, and N-vinylpyrrolidone.

Other vinyl monomer includes: an acrylic acid derivative and a methacrylic acid derivative, such as vinyl naphthalene, acrylonitrile, methacrylonitrile, and acrylamide.

These vinyl-based monomers can be used separately or in combination of two or more thereof.

The polymerization initiator applied to manufacture the vinyl-based resin includes: azo or diazo group polymerization initiator such as 2,2'-azobis-(2,4-dimethyl valeronitrile), 2,2'-azobis isobutylonitrile, 1,1'-azobis(cyclohexane-1-carbonitrile), 2,2'-azobis-(4-methoxy-2,4-dimethyl valeronitrile), and azobisisobutylonitrile; peroxide-based initiator or initiator having peroxide at the side chain thereof, such as benzoyl peroxide, methylethylketone peroxide, di-isopropylperoxy carbonate, cumene hydroperoxide, t-butyl hydroperoxide, di-t-butylperoxide, di-acylperoxide, 2,4-dichlorobenzoyl peroxide, lauroyl peroxide, 2,2-bis(4,4-t-butylperoxy cylohexyl)propane, and tris-(t-butylperoxy)triazine; persulfate such as potassium persulfate and ammonium persulfate; and hydrogen peroxide.

Further, as for trifunctional or more radical polymeric polymerization initiators, there may be given those such as, radical polymeric multifunctional polymerization initiators such as tris(t-butylperoxy) triazine, vinyltris(t-butylperoxy) silane, 2,2-bis(4,4-di-t-butylperoxy cyclohexyl) propane, 2,2-bis(4,4-di-t-amyl peroxy cyclohexyl) propane, 2,2-bis(4,4-di-t-octyl peroxy cyclohexyl) propane and 2,2-bis(4,4-di-t-butylperoxy cyclohexyl) butane.

The first mode toner and second mode toner preferably include wax as a release agent and charge control agent such as organic metal complex.

The toner used for the two-component developer and the supplemental developer includes a coloring agent. The coloring agent here may be a pigment or dye or a combination thereof.

The dye includes C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

The pigment includes Mineral Fast Yellow, Naval Yellow, Naphthol Yellow S, Hanza Yellow G, Permanent Yellow NCG, Tartrazine Lake, Molybdenum Orange, Permanent Orange GTR, Pyrrazolon Orange, Benzidine Orange G, Permanent Red 4R, Watching Red Potassium Salt, Eocine Lake, Brilliant Carmine 3B, Manganese Purple, Fast Violet B, Methylviolet Lake, Cobalt Blue, Alkali Blue Lake, Victoria Blue Lake, Phthalocyanine Blue, Fast Sky Blue, Indanthrene Blue BC, Chrome Green, Pigment Green B, Malachite Green Lake, and Final Yellow Green G.

When the two-component developer and the supplemental developer are used as the developer for full-color image-forming, the toner can contain a coloring pigment for magenta. The coloring pigment for magenta includes C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238, C.I. Pigment Violet 19, C.I. Vat Red 1, 2, 10, 13, 15, 23, 29, and 35.

The toner particles may contain only the coloring pigment for magenta. However, if they contain a combination of dye with pigment, they improve the color definition of developer and improve the quality of full-color image. Examples of the dye for magenta are: oil-soluble dye such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, C.I. Disperse Violet 1; Basic dye such as C.I. Basic Red 1, 2, 9, 12, 13, 14, 15, 17, 18, 22, 23, 24, 27, 29, 32, 34, 35, 36, 37, 38, 39, and 40, C.I. Basic Violet 1, 3, 7, 10, 14, 15, 21, 25, 26, 27, and 28.

The coloring pigment for cyan includes: C.I. Pigment Blue 2, 3, 15, 15:1, 15:2, 15:3, 16, and 17; C.I. Acid Blue 6; C.I. Acid Blue 45; and copper phthalocyanine pigment prepared by partially substituting the phthalocyanine skeleton with 1 to 5 phthalimidemethyl groups.

The coloring pigment for yellow includes: C.I. Pigment Yellow 1, 2, 3, 4, 5, 6, 7, 10, 11, 12, 13, 14, 15, 16, 17, 23, 65, 73, 74, 83, 93, 97, 155, and 180, and C.I. Vat Yellow 1, 3, and 20.

The black pigment includes: carbon black such as Furnace Black, Channel Black, Acetylene Black, Thermal Black, and Lamp Black; and magnetic powder such as magnetite and ferrite.

Furthermore, the toning may be done by combining Magenta dye and pigment, Yellow dye and pigment, Cyan dye and pigment, and they may be used together with above carbon black.

Figure 8:
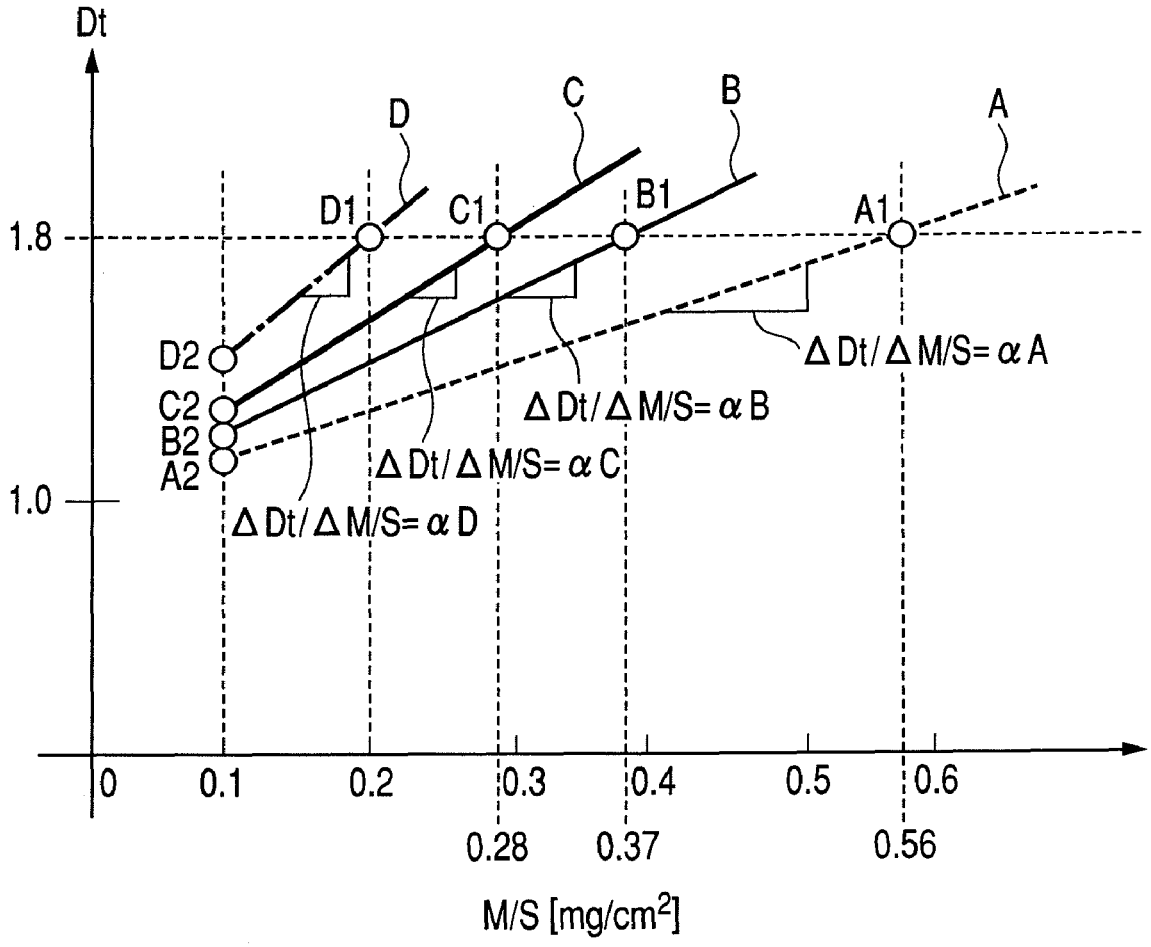
FIG. 8 is a graph for illustrating a relationship between a tinting strength of the toner and the toner bearing amount.

B. Inclination of the Transmission Density with Respect to the Toner Bearing Amount FIG. 8 illustrates relationship between the toner bearing amount M/S on the paper and the transmission density Dt. FIG. 8 illustrates relationships of several kinds of toners, the tinting strength of which is changed using the above-described material and manufacturing method.

It should be noted that the abscissa in FIG. 8 indicates changes of the toner bearing amount on the paper when the Vc is changed with respect to a flat VL potential by changing the flat VL potential as the latent image electrical potential by controlling the Vd, laser power and the Vdc. That is, the graph illustrated in FIG. 8 is different from the gradation curve with respect to a digital latent image illustrated in FIG. 2, which is obtained from a desired number of lines.

The case of, for example, cyan toner will be described. Line A in FIG. 8 represents changes in density of a conventional common toner (relationship between the toner bearing amount and the transmission density Dt on the paper). The line A represents a result of an image which was output using a toner prepared by mixing, for example, a coloring agent of pigment blue, which was a cyan pigment of 15:3, 4 to 5 parts by mass with respect to the mass of entire toner.

Line B in FIG. 8 represents a result of an image, which was output using a toner prepared by adding the coloring agent 1.5 times as much as the toner with which the result of the line A was obtained. Line C in FIG. 8 represents a result of an image, which was output using a toner prepared by adding the coloring agent two times as much as the toner with which the result of the line A was obtained. Line D in FIG. 8 represents a result of an image, which was output using a toner prepared by adding the coloring agent three times as much as the toner with which the result of the line A was obtained.

Each of point-A1, point-B1, point-C1 and point-D1 in FIG. 8 represents a maximum toner bearing amount $(M/S)_{La}$ on the paper to obtain the Dtmax=1.8 using the toner with which the respective results of the line A, line B, line C and line D were obtained. The $(M/S)_{La}$ represents the toner bearing amount on the paper after the $(M/S)_L$ on the photosensitive member was transferred and fixed onto the paper with the transfer efficiency $\lambda(\leqq 1)$ (which will be described later). In this embodiment, the $(M/S)_{La}$ represents the toner bearing amount after the toner layer formed on the photosensitive member through the developing process was transferred onto the paper via the intermediate transfer member through the transfer process twice after the developing process was completed. It is assumed that, after the fixing process, there was no change in toner bearing amount after the transfer process was completed. The toner bearing amounts $(M/S)_{La}$ on the paper at the point-A1, point-B1, point-C1 and point-D1 were as listed below. The transmission densities at each of the point-A1, point-B1, point-C1 and point-D1 (i.e., equivalent to the maximum density Dtmax=1.8) will be also referred to as DtA1, DtB1, DtC1 and DtD1 respectively.

Point-A1: 0.56 mg/cm$^2$
Point-B1: 0.37 mg/cm$^2$
Point-C1: 0.28 mg/cm$^2$
Point-D1: 0.20 mg/cm$^2$ Each of point-A2, point-B2, point-C2 and point-D2 in FIG. 8 represents transmission density Dt when the toner bearing amount on the paper was 0.1 mg/cm$^2$, using the toner with which the respective results of the line A, line B, line C and line D were obtained. The transmission densities Dt at the point-A2, point-B2, point-C2 and point-D2 were as listed below. The transmission densities at the point-A2, point-B2, point-C2 and point-D2 will be also referred to as DtA2, DtB2, DtC2 and DtD2 respectively.

Point-A2: 1.14
Point-B2: 1.22
Point-C2: 1.29
Point-D2: 1.41

The inclinations α of the respective lines A to D are expressed by the following formulae.

$$\alpha = \frac{(Dt\max - Dt_{0.1})}{\left\{\lambda \times \left(\frac{M}{S}\right)_L - 0.1\right\}} = \frac{(1.8 - Dt_{0.1})}{\left\{\lambda \times \left(\frac{M}{S}\right)_L - 0.1\right\}} \quad (3)$$

$\lambda\times(M/S)_L$ in the formula (3) representing the inclination α can be substituted with the following formula:

$$\lambda \times \left(\frac{M}{S}\right)_L = \left(\frac{M}{S}\right)_{La}$$

The $Dt_{0.1}$ in the formula (3) representing the inclination α represents the transmission density Dt when the toner bearing amount on the paper is 0.1 mg/cm$^2$. Also, the λ in the formula (3) representing the inclination α represents the transfer efficiency. In this embodiment, as an example, the total transfer efficiency λ including the primary transfer device and the secondary transfer device is approximately 93%.

Therefore, the inclination αA of the line A in FIG. 8 is calculated as the following calculation. The transmission density at the point-A1 is DtA1=1.8; and DtA2=1.14 at the point-A2. The toner bearing amount on the paper is 0.56 mg/cm$^2$ at the point-A1; and 0.1 mg/cm$^2$ at the point-A2. The maximum toner bearing amount $(M/S)_L$ on the photosensitive member is 0.6 mg/cm$^2$.

$$\alpha A=(1.8-1.14)/(0.56-0.1)=1.43\ \text{cm}^2/\text{mg}$$

The inclination αB of the line B in FIG. 8 is calculated as the following calculation. The transmission density at the point-B1 is DtB1=1.8; and DtB2=1.22 at the point-B2. The toner bearing amount on the paper at point-B1 is 0.37 mg/cm$^2$; and 0.1 mg/cm$^2$ at the point-B2. The maximum toner bearing amount $(M/S)_L$ on the photosensitive member is 0.4 mg/cm$^2$.

$$\alpha B=(1.8-1.22)/(0.37-0.1)=2.15\ \text{cm}^2/\text{mg}$$

The inclination αC of the line C in FIG. 8 is calculated as the following calculation. The transmission density at the point-C1 is DtC1=1.8; and DtC2=1.29 at the point-C2. The toner bearing amount on the paper at the point-C1 is 0.28 mg/cm$^2$; and 0.1 mg/cm$^2$ at the point-C2. The maximum toner bearing amount $(M/S)_L$ on the photosensitive member is 0.3 mg/cm$^2$.

$$\alpha C=(1.8-1.29)/(0.28-0.1)=2.83\ \text{cm}^2/\text{mg}$$

The inclination αD of the line D in FIG. 8 is calculated as the following calculation. The transmission density at the point-D1 is DtD1=1.8; and DtD2=1.41 at the point-D2. The toner bearing amount on the paper at the point-D1 is 0.20 mg/cm$^2$; and 0.1 mg/cm$^2$ at the point-D2. The maximum toner bearing amount $(M/S)_L$ on the photosensitive member is 0.22 mg/cm$^2$.

$$\alpha D=(1.8-1.41)/(0.2-0.1)=3.9\ \text{cm}^2/\text{mg}$$

That is, in the toner which is prepared using X times of the coloring agent, the inclination of the transmission density Dt is substantially X times with respect to the toner bearing amount M/S on the paper. It is understood that the inclination α represents the tinting strength of the toner.

As described in detail below, the invention prescribes a range of $(M/S)_L$, $(Q/M)_L$, and a product of the inclination α (i.e., tinting strength of the toner) of the transmission density Dt with respect to the toner bearing amount on the transfer material and an inverse number of the $(Q/M)_L$. That is, the invention prescribes the range of parameters representing the relationship between the tinting strength of the toner that permits the reduction of the toner bearing amount and the toner charge amount that can ensure the image stability and image quality.

C. Inclination α and Inverse Number of $(Q/M)_L$

Next, the relationship among $(M/S)_L$, $(Q/M)_L$ and the inclination α will be described.

For example, when the maximum toner bearing amount $(M/S)_L$ on the photosensitive member is 0.6 mg/cm$^2$ at Vc=150 V, from the results illustrated in FIG. 1, the $(Q/M)_L$ required for achieving 100% of the charging efficiency is approximately 22.8 μC/g. Defining the inverse number $(M/Q)_L$ of $(Q/M)_L$ as β, the β is obtained by the following calculation. In this specification, if not otherwise specified, similarly to the charge amount of the toner (amount of electric charge), the β as the inverse number thereof is also expressed with the absolute value thereof.

$$\beta=1/(Q/M)_L=1/22.8\ \mu C/g$$

To obtain the maximum density Dtmax=1.8 using the toner of the toner bearing amount $(M/S)_{La}$=0.56 mg/cm$^2$ (the line A) after an image of the maximum density of $(M/S)_L$32 0.6 mg/cm$^2$ on the photosensitive member is transferred onto the paper, the inclination αA is 1.43 cm$^2$/mg.

The product of the inclination αA and the β is obtained by the following calculation.

$$\alpha A\times\beta=1.43\ cm^2/mg\times1/22.8\ \mu C/g=62.7\ cm^2/\mu C$$

Likewise, for example, when the maximum toner bearing amount $(M/S)_L$ on the photosensitive member is 0.4 mg/cm$^2$ at Vc=150 V, from the results illustrated in FIG. 1, the $(Q/M)_L$ required for achieving 100% of the charging efficiency is approximately 36.2 μC/g. The β at this time is obtained by the following calculation.

$$\beta=1/(Q/M)_L=1/36.2\ \mu C/g$$

To obtain the maximum density Dtmax=1.8 using the toner of the toner bearing amount $(M/S)_{La}$=0.37 mg/cm$^2$ (line B) after an image of the maximum density of $(M/S)_L$=0.4 mg/cm$^2$ on the photosensitive member is transferred onto the paper, the inclination αB is 2.15 cm$^2$/mg.

The product of the inclination αB and the β is obtained by the following calculation.

$$\alpha B\times\alpha=2.15\ cm^2/mg\times1/36.2\ \mu C/g=59.4\ cm^2/\mu C$$

Likewise, for example, when the maximum toner bearing amount $(M/S)_L$ on the photosensitive member is 0.3 mg/cm$^2$ at Vc=150 V, from the results illustrated in FIG. 1, the $(Q/M)_L$ required for achieving 100% of the charging efficiency is approximately 50 μC/g. The β at this time is obtained by the following calculation.

$$\beta=1/(Q/M)_L=1/50\ \mu C/g$$

To obtain the maximum density Dtmax=1.8 using the toner of the toner bearing amount $(M/S)_{La}$=0.28 mg/cm$^2$ (line C) after an image of the maximum density of $(M/S)_L$=0.3 mg/cm$^2$ on the photosensitive member is transferred onto the paper, the inclination αC is 2.83 cm$^2$/mg.

The product of the inclination αC and the β is obtained by the following calculate.

$$\alpha C\times\beta=2.83\ cm^2/mg\times1/50\ \mu C/g=56.6\ cm^2/\mu C$$

Likewise, for example, when the maximum toner bearing amount $(M/S)_L$ on the photosensitive member is 0.22 mg/cm$^2$ at Vc=150 V, from the results illustrated in FIG. 1, the $(Q/M)_L$ required for achieving 100% of the charging efficiency is approximately 70.1 μC/g. The β at this time is obtained by the following calculation.

$$\beta=1/(Q/M)_L=1/70.1\ \mu C/g$$

To obtain the maximum density Dtmax=1.8 using the toner of the toner bearing amount $(M/S)_{La}$=0.2 mg/cm$^2$ (line D) after an image of the maximum density of $(M/S)_L$=0.22 mg/cm$^2$ on the photosensitive member is transferred onto the paper, the inclination αD is 3.9 cm$^2$/mg.

The product of the inclination αD and the β is obtained by the following calculation.

$$\alpha D\times\oplus=3.9\ cm^2/mg\times1/70.1\ \mu C/g=55.6\ cm^2/\mu C$$

Figure 9:
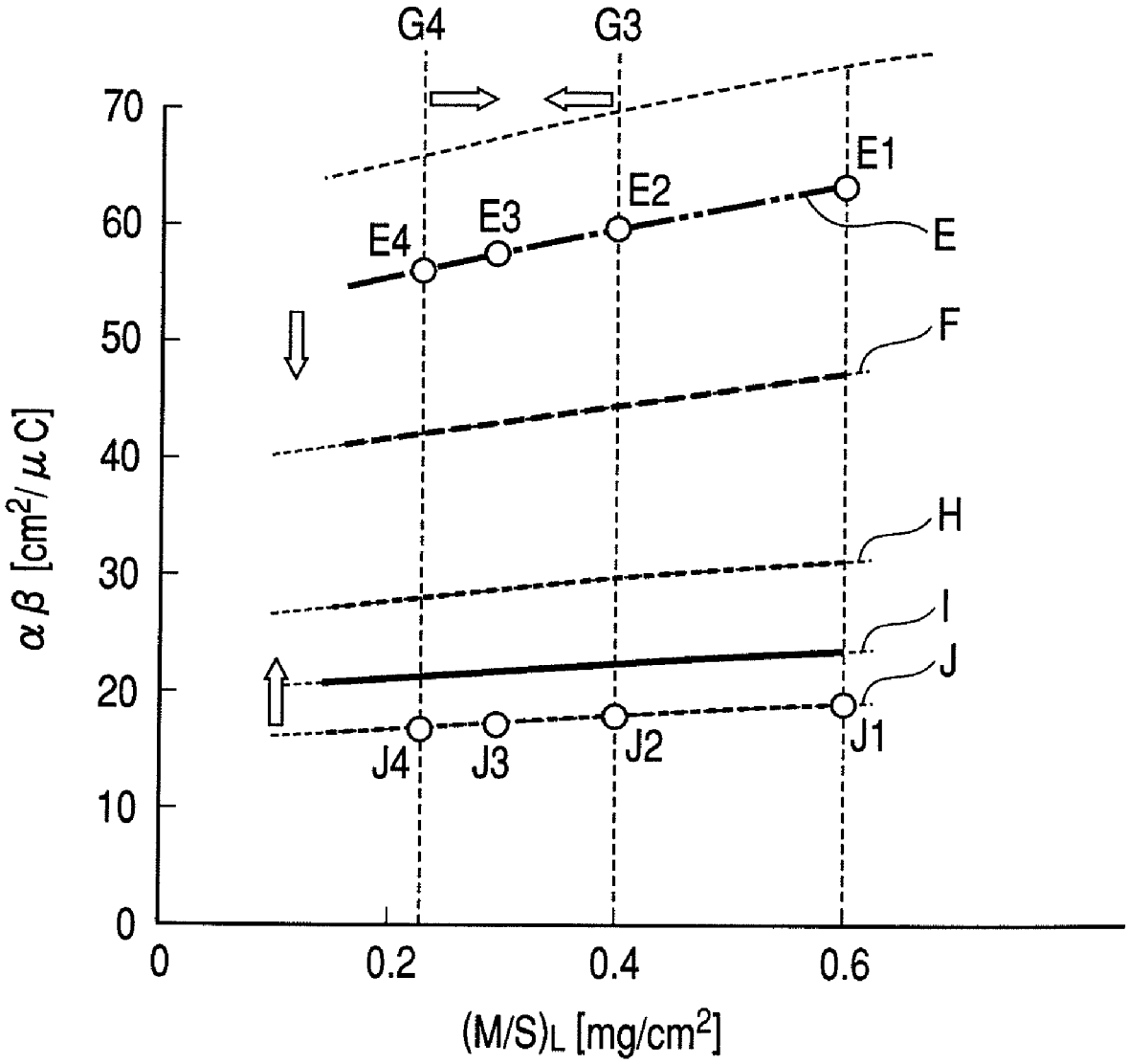
FIG. 9 is a graph for illustrating a relationship between tinting strength of the toner and the toner charge amount.

FIG. 9 illustrates a relationship between the $(M/S)_L$ and the αβ obtained as described above.

Line E in FIG. 9 is a line obtained by plotting the αA×β, αB×β, αC×β and αD×β at Vc=150V. That is, the line E is a line obtained by multiplying the inclination α for obtaining ⊃tmax=1.8 with a desired $(M/S)_L$ and the inverse number β of the $(Q/M)_L$ required for achieving 100% of the charging efficiency at Vc=150 V. Each of point E1, point E2, point E3 and point E4 in FIG. 9 indicates the value of the αA×β, αB×β, αC×β and αD×β respectively at Vc=150 V.

In the same manner as the case of the line E (Vc=150 V), for each cases of Vc=200 V, Vc=300 V, Vc=400 V and Vc=500 V, a line represents the relationship between the $(M/S)_L$ and the αβ can be obtained respectively. In FIG. 9, a line F represents the case of Vc=200 V, a line H represents the case of Vc=300 V, a line I represents the case of Vc=400 V and a line J represents the case of Vc=500 V.

The case of the line J will be further described in detail.

At Vc=500 V, when the maximum toner bearing amount $(M/S)_L$ on the photosensitive member is 0.6 mg/cm$^2$, the $(Q/M)_L$ required for achieving 100% of the charging efficiency is, from the results illustrated in FIG. 1, approximately 76.1 μC/g. The β at this time is obtained by the following calculation.

$$\beta=1/(Q/M)_L=1/76.1\ \mu C/g$$

After an image of the maximum density $(M/S)_L$=0.6 mg/cm$^2$ on the photosensitive member is transferred onto the paper, the inclination αA to obtain the maximum density Dtmax=1.8 using the toner of the toner bearing amount $(M/S)_{La}$=0.56 mg/cm$^2$ (line A) is 1.43 cm$^2$/mg.

The product of the inclination αA and the β is obtained by the following calculation.

$$\alpha A\times\beta=1.43\ cm^2/mg\times1/76.1\ \mu C/g=18.8\ cm^2/\mu C$$

Likewise, at Vc=500 V, when the maximum toner bearing amount $(M/S)_L$ on the photosensitive member is 0.4 mg/cm$^2$, the $(Q/M)_L$ required for achieving 100% of the charging efficiency is, from the results illustrated in FIG. 1, approximately 120 μC/g. The β at this time is obtained by the following calculation.

$$\beta=1/(Q/M)_L=1/120\ \mu C/g$$

After an image of the maximum density $(M/S)_L$=0.4 mg/cm$^2$ on the photosensitive member is transferred onto the paper, the inclination αB to obtain the maximum density Dtmax=1.8 using the toner of the toner bearing amount $(M/S)_{La}$=0.37 mg/cm$^2$ (line B) is 2.15 cm$^2$/mg.

The product of the inclination αB and the β is obtained by the following calculation.

$$\alpha B \times \beta = \mathbf{2.15}\ \text{cm}^2/\text{mg} \times 1/120\ \mu\text{C/g} = 17.9\ \text{cm}^2/\mu\text{C}$$

Likewise, at Vc=500 V, when the maximum toner bearing amount $(M/S)_L$ on the photosensitive member is 0.3 mg/cm$^2$, the $(Q/M)_L$ required for achieving 100% of the charging efficiency is, from the results illustrated in FIG. 1, approximately 166 μC/g. The β at this time is obtained by the following calculation.

$$\beta = 1/(Q/M)_L = 1/166\ \mu\text{C/g}$$

After an image of the maximum density $(M/S)_L$=0.3 mg/cm$^2$ on the photosensitive member is transferred onto the paper, the inclination αC to obtain the maximum density Dtmax=1.8 using the toner of the toner bearing amount $(M/S)_{La}$=0.28 mg/cm$^2$ (line C) is 2.83 cm$^2$/mg.

The product of the inclination αC and the β is obtained by the following calculation.

$$\alpha C \times \beta = 2.83\ \text{cm}^2/\text{mg} \times 1/166\ \mu\text{C/g} = 17.0\ \text{cm}^2/\mu\text{C}$$

Likewise, at Vc=500 V, when the maximum toner bearing amount $(M/S)_L$ on the photosensitive member is 0.22 mg/cm$^2$, the $(Q/M)_L$ required for achieving 100% of the charging efficiency is, from the results illustrated in FIG. 1, approximately 234 μC/g. The β at this time is obtained by the following calculation.

$$\beta = 1/(Q/M)_L = 1/234\ \mu\text{C/g}$$

After an image of the maximum density $(M/S)_L$=0.22 mg/cm$^2$ on the photosensitive member is transferred onto the paper, the inclination αD to obtain the maximum density Dtmax=1.8 using the toner of the toner bearing amount $(M/S)_{La}$=0.2 mg/cm$^2$ (line D) is 3.9 cm$^2$/mg.

The product of the inclination αD and the β is obtained by the following calculation.

$$\alpha D \times \beta = 3.9\ \text{cm}^2/\text{mg} \times 1/234\ \mu\text{C/g} = 16.7\ \text{cm}^2/\mu\text{C}$$

Each of point J1, point J2, point J3 and point J4 in FIG. 9 indicates a value of αA×β, αB×β, αC×β and αD=33 β at Vc=500 V respectively.

D. Range of αβ

The range of αβ will be described below.

As described above, the $(M/S)_L$ is desirably within a range of 0.22 mg/cm$^2$≦$(M/S)_L$≦0.4 mg/cm$^2$. With this, the toner bearing amount can be reduced effectively.

Therefore, the $(M/S)_L$ is within a range of a line G4 indicating 0.22 mg/cm$^2$ or above and a line G3 indicating 0.4 mg/cm$^2$ or below in FIG. 9.

Further, as described above, taking a practical value into consideration, the maximum developing contrast Vc is desirable to be within the following range:

$$150\ \text{V} \leqq \text{Vc} \leqq 500\ \text{V} \qquad (1)\text{-}4.$$

Therefore, the αβ is within a range of the line J at Vc=500 V or above and the line E at Vc=150 V or below in FIG. 9.

Here, as described above, the inclination α is expressed by the following formula.

$$\alpha = \frac{(Dt\max - Dt_{0.1})}{\left\{\lambda \times \left(\frac{M}{S}\right)_L - 0.1\right\}} \qquad (3)$$

As described above, the β is an inverse number of the $(Q/M)_L$, and is expressed by the following formula:

$$\beta = 1/(Q/M)_L = (M/Q)_L.$$

Therefore, the αβ is expressed by the following formula.

$$\alpha\beta = \frac{(Dt\max - Dt_{0.1})}{\left\{\lambda \times \left(\frac{M}{S}\right)_L - 0.1\right\}} \times \left(\frac{M}{Q}\right)_L \qquad (4)$$

From the above formula (2) and the above formula (4), the range of the line J or above and the line E or below in FIG. 9 can be expressed by the following formula.

$$\frac{\frac{(Dt\max - Dt_{0.1})}{\left\{\lambda \times \left(\frac{M}{S}\right)_L - 0.1\right\}}\left(\frac{Lt}{2\varepsilon_0\varepsilon_t} + \frac{Ld}{\varepsilon_0\varepsilon_d}\right) \times \left(\frac{M}{S}\right)_L}{500} \leq \alpha\beta \leq \frac{\frac{(Dt\max - Dt_{0.1})}{\left\{\lambda \times \left(\frac{M}{S}\right)_L - 0.1\right\}}\left(\frac{Lt}{2\varepsilon_0\varepsilon_t} + \frac{Ld}{\varepsilon_0\varepsilon_d}\right) \times \left(\frac{M}{S}\right)_L}{150}$$

That is, the above formula can be also derived from the formula (1)-4 and formula (4).

Further, since the toner charge amount possible to be actually handled is 150 μC/g or more, the following formula is derived from the above formula (4).

$$\left(\frac{Q}{M}\right)_L = \frac{(Dt\max - Dt_{0.1})}{\left\{\lambda \times \left(\frac{M}{S}\right)_L - 0.1\right\}} \times \frac{1}{\alpha\beta} \leq 150$$

Therefore, the αβ satisfies the following formula.

$$\alpha\beta \geq \frac{\frac{(Dt\max - Dt_{0.1})}{\left\{\lambda \times \left(\frac{M}{S}\right)_L - 0.1\right\}}}{150} \qquad (5)$$

That is, the above formula can be also derived from the formula (2)-2 and formula (4).

Here, a line expressed by the following formula is defined as a line G5.

$$\alpha\beta = \frac{\frac{(Dt\max - Dt_{0.1})}{\left\{\lambda \times \left(\frac{M}{S}\right)_L - 0.1\right\}}}{150}$$

Figure 10:
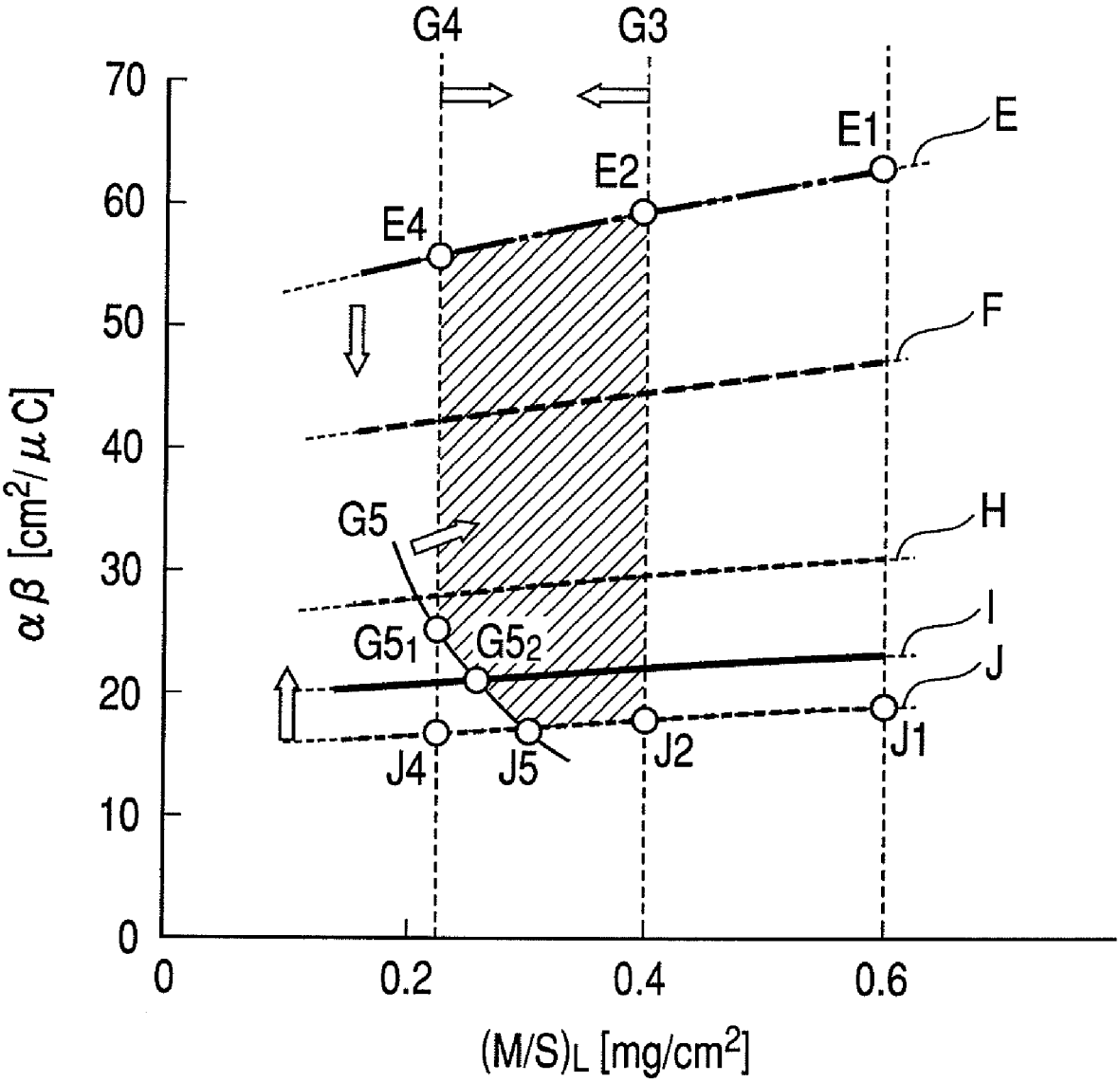
FIG. 10 is a graph for illustrating a range of the tinting strength of the toner and the toner charge amount according to the invention.

In this case, the range indicated by the above formula (5) is a range of the line G5 or above in FIG. 10. FIG. 10 illustrates the same relationship between the $(M/S)_L$ and the αβ as with FIG. 9. Therefore, as described above, the range of the αβ and $(M/S)_L$ for obtaining the γ-characteristic capable of reducing the toner bearing amount and ensuring the stability is a range marked with shadow enclosed by a line E, line J, line G3, line G4 and line G5 in FIG. 10.

In FIG. 10, the αβ and $(M/S)_L$ at an intersection E2 of the line E and line G3, an intersection E4 of the line E and line G4, an intersection J2 of the line J and line G3, and an intersection J5 of the line J and line G5 are as listed below. Further, the αβ and $(M/S)_L$ at an intersection $G5_1$ of the line G4 and line G5 and an intersection $G5_2$ of the line I and line G5 are as listed below.

E2: αβ=59.4 $cm^2/\mu C$, $(M/S)_L$=0.40 $mg/cm^2$
E4: αβ=55.6 $cm^2/\mu C$, $(M/S)_L$=0.22 $mg/cm^2$
J2: αβ=17.9 $cm^2/\mu C$, $(M/S)_L$=0.40 $mg/cm^2$
J5: αβ=17.43 $cm^2/\mu C$, $(M/S)_L$=0.33 $mg/cm^2$
$G5_1$: αβ=26.1 $cm^2/\mu C$, $(M/S)_L$=0.22 $mg/cm^2$
$G5_2$: αβ=21.3 $cm^2/\mu C$, $(M/S)_L$=0.27 $mg/cm^2$

The transmission density Dt has been described above in the case where the OK Topcoat (73.3 $g/m^2$) manufactured by Oji Paper Co., Ltd is used as a typical transfer material. The inventors found that, although there is a small deviation, the inclination depends little on the kind of the transfer material (paper type).

The inclination α has been described taking the cyan toner as an example. However, an object of the invention can be achieved by using the toners of magenta toner, yellow toner and black toner, which are prepared while optimizing the amount of the coloring agents so as to obtain the same α as the above. When an image forming apparatus is designed to perform image forming using multiple color toners, in each single color toner, only the relationship among the Vc, $(M/S)_L$ and $(Q/M)_L$ according to the above-described invention has to be satisfied.

EXPERIMENTAL EXAMPLES

Next, comparative experiments were conducted using the following toners I to VI.

Figure 22:
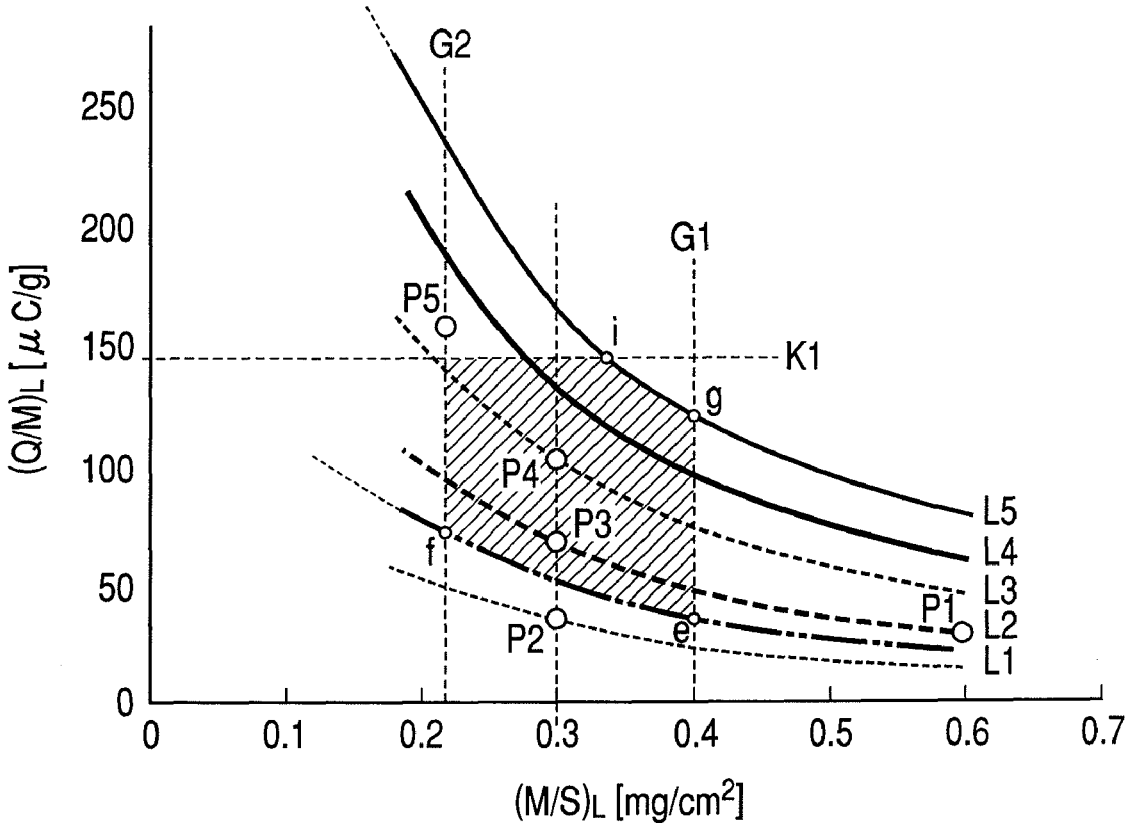
FIG. 22 is a graph for illustrating a result of an experimental example.
Figure 23:
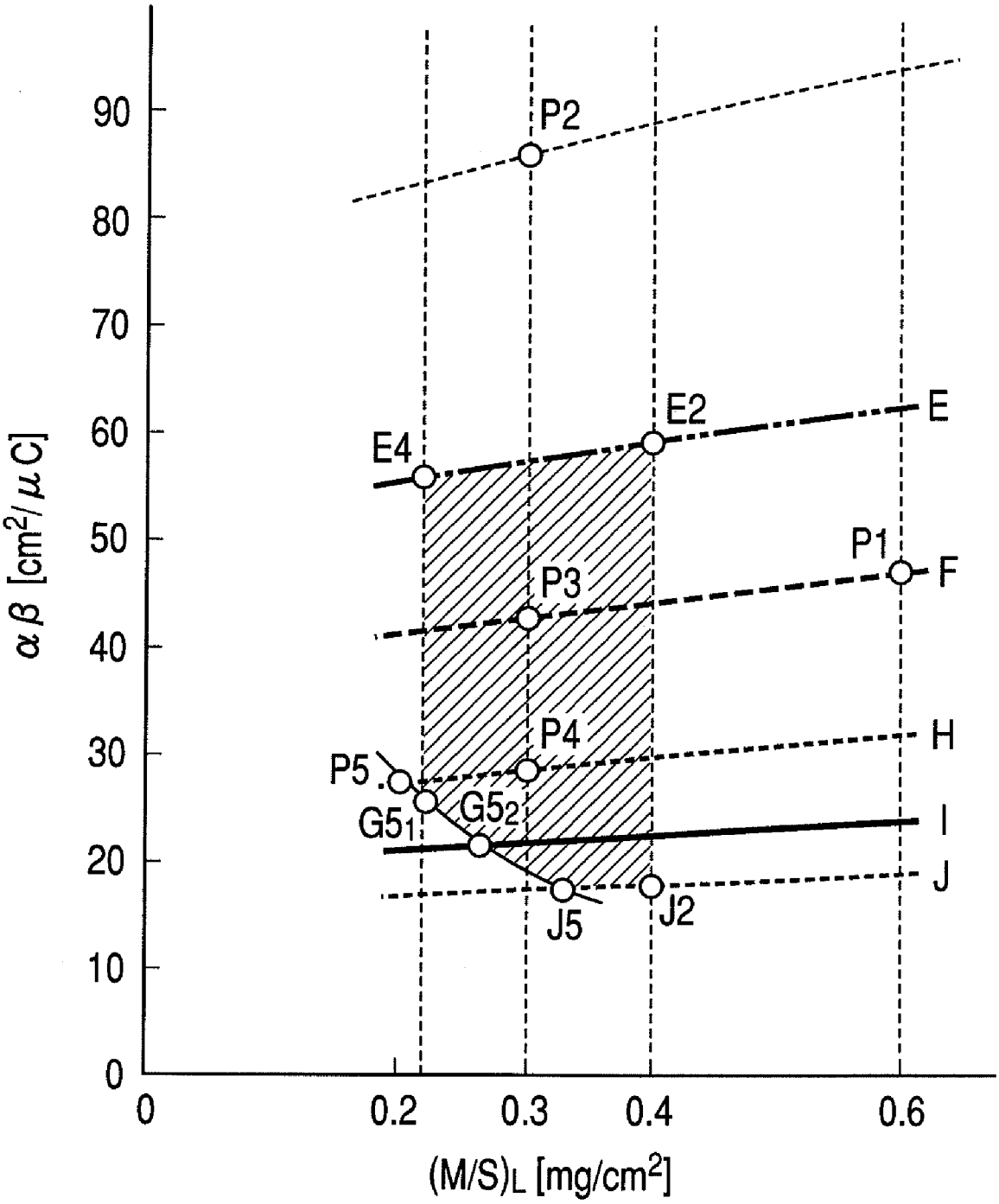
FIG. 23 is a graph for illustrating a result of an experimental example.

For toner I, when the charge amount $(Q/M)_L$ was 30 μC/g, the maximum toner bearing amount $(M/S)_L$ on the photosensitive member was 0.6 $mg/cm^2$ at Vc=200 V. The toner bearing amount $(M/S)_{La}$ on the paper after transferring was 0.56 $mg/cm^2$, and the maximum density Dtmax after fixation was 1.8. When the toner bearing amount on the paper was 0.1 $mg/cm^2$, the transmission density $Dt_{0.1}$ was 1.14. Therefore, the inclination α indicating the tinting strength of the toner I was 1.43 $cm^2/mg$ and the αβ was 47.7 $cm^2/\mu C$. That is, the toner I is at the position of the point P1 in FIG. 22 and FIG. 23. That is, the point P1 is located within a range where a toner having the conventional tinting strength is used.

For toner II, when the charge amount $(Q/M)_L$ was 33 μC/g, the maximum toner bearing amount $(M/S)_L$ on the photosensitive member was 0.3 $mg/cm^2$ at Vc=100 V. The toner bearing amount $(M/S)_{La}$ on the paper after transferring was 0.28 $mg/cm^2$, and the maximum density Dtmax after fixation was 1.8. When the toner bearing amount on the paper was 0.1 $mg/cm^2$, the transmission density $Dt_{0.1}$ was 1.29. Therefore, the inclination α indicating the tinting strength of the toner II was 2.83 $cm^2/mg$ and the αβ was 85.9 $cm^2/\mu C$. That is, the toner II is at the position of point-P2 in FIG. 22 and FIG. 23. That is, the point P2 is located within a range where a toner having a high tinting strength is used, and the toner bearing amount is reduced by reducing the Vc, which is the conventional technique.

For toner III, when the charge amount $(Q/M)_L$ was 66 μC/g, the maximum toner bearing amount $(M/S)_L$ on the photosensitive member was 0.3 $mg/cm^2$ at Vc=200 V. The toner bearing amount $(M/S)_{La}$ on the paper after transferring was 0.28 $mg/cm^2$, and the maximum density Dtmax after fixation was 1.8. When the toner bearing amount on the paper was 0.1 $mg/cm^2$, the transmission density $Dt_{0.1}$ was 1.29. Therefore, the inclination α indicating the tinting strength of the toner III was 2.83 $cm^2/mg$ and the αβ was 42.9 $cm^2/\mu C$. That is, the toner III is at the position of point P3 in FIG. 22 and FIG. 23. That is, the point P3 is located within a range where a toner having a high tinting strength is used, and the toner bearing amount is reduced under the same setting of the Vc as the conventional (i.e., without reducing Vc).

For toner IV, when the charge amount $(Q/M)_L$ was 100 μC/g, the maximum toner bearing amount $(M/S)_L$ on the photosensitive member was 0.3 $mg/cm^2$ at Vc=300 V. The toner bearing amount $(M/S)_{La}$ on the paper after transferring was 0.28 $mg/cm^2$, and the maximum density Dtmax after fixation was 1.8. When the toner bearing amount on the paper was 0.1 $mg/cm^2$, the transmission density $Dt_{0.1}$ was 1.29. Therefore, the inclination α indicating the tinting strength of the toner IV was 2.83 $cm^2/mg$ and αβ was 28.3 $cm^2/\mu C$. That is, the toner IV is at the position of point-P4 in FIG. 22 and FIG. 23. That is, the point-P4 is located within a range where a toner having a high tinting strength is used, and the toner bearing amount is reduced under the setting of the Vc greater than that of the conventional art.

For toner V, when the charge amount $(Q/M)_L$ was 160 μC/g, the maximum toner bearing amount $(M/S)_L$ on the photosensitive member was 0.2 $mg/cm^2$ at Vc=400 V. The toner bearing amount $(M/S)_{La}$ on the paper after transferring was 0.14 $mg/cm^2$, and the maximum density Dtmax after fixation was 1.8. When the toner bearing amount on the paper was 0.1 $mg/cm^2$, the transmission density $Dt_{0.1}$ was 1.63. Therefore, the inclination α indicating the tinting strength of the toner V was 4.3 $cm^2/mg$ and αβ was 26.9 $cm^2/\mu C$. That is, the toner V is at the position of point P5 in FIG. 22 and FIG. 23. That is, the point P5 is located within a range where a toner having a high tinting strength is used, and the toner bearing amount is reduced under the setting of the Vc greater than the conventional art.

For toner VI, when the charge amount $(Q/M)_L$ was 66 μC/g, the maximum toner bearing amount $(M/S)_L$ on the photosensitive member was 0.3 $mg/cm^2$ at Vc=400 V. The toner bearing amount $(M/S)_{La}$ on the paper after transferring was 0.28 $mg/cm^2$, and the maximum density Dtmax after fixation was 1.8. When the toner bearing amount on the paper was 0.1 $mg/cm^2$, the transmission density $Dt_{0.1}$ was 1.29. Therefore, the inclination α indicating the tinting strength of the toner VI was 2.83 $cm^2/mg$ and αβ=42.9 $cm^2/\mu C$. That is, the toner VI is at the position of point P3 in FIG. 22 and FIG. 23 as with the toner III. That is, the point P3 is located within a range where a toner having a high tinting strength is used, and the toner bearing amount is reduced under the setting of the Vc greater than the conventional art.

Using the toners I to VI, evaluation was made on the stability and defective image. The results will be summarized below.

Blank area and coarseness as the evaluation items were subjectively evaluated (classified as A, B, C, D in descending order of good state). As for the stability of the density, in a halftone image of Dt=1.0, with respect to the developing contrast change ΔVcont at 10 V, when the density change Δdt was not less than 0.1, the density stability was evaluated as defective (D), when the density change Δdt was less than 0.1, acceptable (B) or excellent (A). As for the fogged image, when the fog density was 2% or more at Vb=150 V, the fogged image was evaluated as defective (D); when less than 2%, the fogged image was evaluated as acceptable (B) or excellent (A). As for the carrier adhesion, when adhered particles are $3/cm^2$ or more, the carrier adhesion was evaluated as defective (D), when less than $3/cm^2$, the carrier adhesion was evaluated as acceptable (B) or excellent (A).

The fogged image density was qualitatively evaluated based on the values obtained by measuring the density in a blank area using a reflection densitometer manufactured by Macbeth (SERIES 1200). The carrier adhesion was qualitatively evaluated based on the values obtained by collecting carriers adhered on the photosensitive member using a piece of "Mylar" tape and by counting the number of the carriers per 1 $cm^2$ through a microscope.

TABLE 1

| | $(Q/M)_L$ (μC/g) | Vc (V) | $(M/S)_L$ ($mg/cm^2$) | Charging efficiency (%) | Blank area | Density stability | coarseness | Fogged image | Carrier adhesion |
|---|---|---|---|---|---|---|---|---|---|
| Toner I | 30 | 200 | 0.6 | 100 | B | B | B | B | B |
| Toner II | 30 | 100 | 0.3 | 100 | B | D | D | D | B |
| Toner III | 60 | 200 | 0.3 | 100 | B | B | B | A | B |
| Toner IV | 100 | 300 | 0.3 | 100 | B | A | A | A | C |
| Toner V | 160 | 400 | 0.2 | 75 | D | A | C | C | D |
| Toner VI | 60 | 400 | 0.3 | 50 | D | B | B | B | B |

Toner I (Comparative example) was a conventional common toner. An image was formed using the toner I with conventional general toner bearing amount. Although no effect to reduce the toner bearing amount was obtained, a generally stable and satisfactory image was formed as with the conventional art.

Toner II (comparative example) was a toner having a higher tinting strength than that of the toner I. Using the toner II, the toner bearing amount was reduced by reducing the maximum developing contrast Vc. In this case, the level of density stability, coarseness and fogged image was reduced compared to the case where toner I was used as described above.

Toner III (embodiment) was a toner having a higher tinting strength than that of the toner I. Using the toner III, the maximum developing contrast Vc was controlled to be the same as that of the case where the toner I was used. In this case, the effect to ensure the density stability and to reduce the coarseness was obtained and fogged image was also improved. The reason that the fogged image was improved than in the example where the toner I was used is understood as below. That is, since the toner charge amount was made higher, the number of toner particles with low charge amount due to the fogged image was reduced.

For the toner IV (embodiment), the toner charge amount was made to be higher than that of the toner III, the inclination of the Vc (γ-characteristic) was reduced. Therefore, the density stability, coarseness and fogged image were improved better than those in the example where the toner III was used.

For the toner V (comparative example), the toner charge amount was made further higher than that of the toner IV to reduce the inclination of the Vc (-characteristic). In this case, blank area was generated and remarkable carrier adhesion was found. The reason of this is understood as described below. First, the charge amount of the toner was too high resulting in a defective development in which, the toner was not released from the carrier; and then the blank area was generated accompanying the reduction of the charging efficiency. That is, the toner V failed to satisfy the relationship among the Vc, (M/S)L and (Q/M)L according to the above-described invention. Also, since the charge amount at the carrier side was also increased, the carrier adhesion in non-image portion was increased. Further, accompanying this, the coarseness in the halftone area increased and the fogged image in the blank area also increased.

Toner VI (comparative example) has the same toner charge amount as that of the toner III. However, even when $(Q/M)_L$= 66 μC/g, Vc=400 V was required to develop $(M/S)_L$=0.3 $mg/cm^2$. Therefore, the developability was low and the charging efficiency was reduced resulting in a generation of blank area. Therefore, the toner VI, as with the toner V, failed to satisfy the relationship among the Vc, $(M/S)_L$ and $(Q/M)_L$ according to the above-described present invention.

As describe above, according to the embodiment, the problem of poor in stability and degrading of the image quality, which conventionally occurred when the toner bearing amount was reduced, is prevented. The toner bearing amount can be reduced while ensuring the same or higher stability and image quality than the conventional art. Thus, high productivity of the image forming apparatus can be achieved while reducing the power consumption, toner relief and running cost.

[Measuring Method]

Toner Bearing Amount and Toner Charge Amount (Average Charge Amount) on the Photosensitive Member The toner bearing amount and the toner charge amount (average charge amount) on the photosensitive member were measured as described below.

Figure 27:
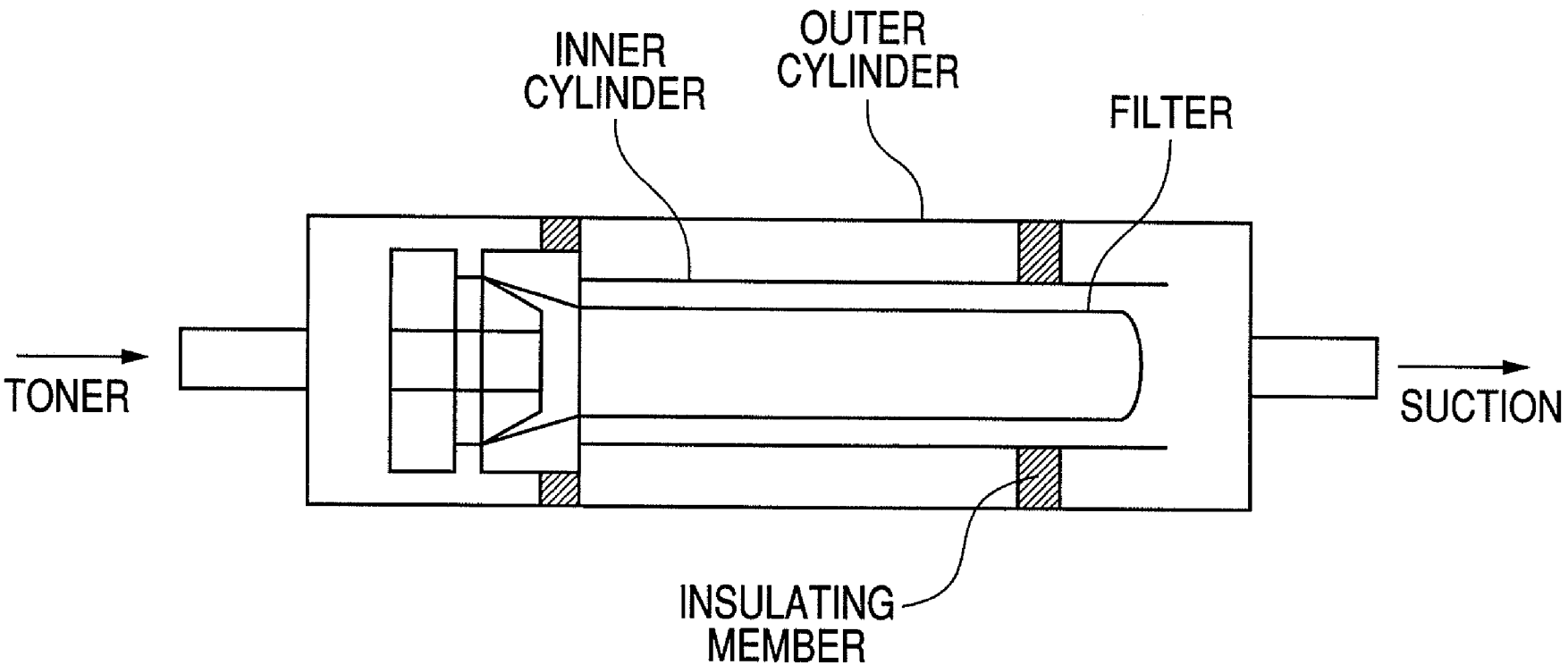
FIG. 27 is a schematic view of a Faraday gauge used for obtaining a toner charging amount and a toner bearing amount.

To facilitate the measurement of the toner on the photosensitive member, during an image forming operation, immediately after the toner was developed on the photosensitive member, the power source for the image forming apparatus was turned off. Using a Faraday gauge including outer and inner metal cylinders each having a different axial diameter disposed coaxially and further including a filter for taking the toner into the inner cylinder as shown in FIG. 27, the toner on the photosensitive member was sucked by an air. The inner cylinder and the outer cylinder of the Faraday gauge are isolated from each other. When the toner is sucked into the filter, electrostatic induction due to the amount of electric charge Q of the toner is generated. The induced amount of electric charge Q was measured using a Coulomb meter (KEITHLEY 616 DIGITAL ELECTROMETER). The measured value was divided by the toner weight M within the inner cylinder; thereby charge amount Q/M (μC/g) of the toner was obtained. The sucked area S on the photosensitive member was measured and the toner weight M was divided by the value; thereby the toner bearing amount M/S ($mg/cm^2$) was obtained.

Toner Bearing Amount on the Paper

The toner bearing amount on the paper was measured using the same technique as that of the toner bearing amount on the photosensitive member.

Thickness of the Toner Layer (Height)

The thickness (height) of the toner layer was measured as described below.

Using a three-dimensional configuration measuring laser microscope (VK-9500 manufactured by KEYENCE), the height was measured at a portion where the toner layer existed and at a portion where no toner layer existed on the photosensitive member, and difference therebetween was calculated to obtain the thickness Lt of the toner layer.

Relative Permittivity of the Toner Layer

The relative permittivity of the toner layer was measured as described below.

Figure 28:
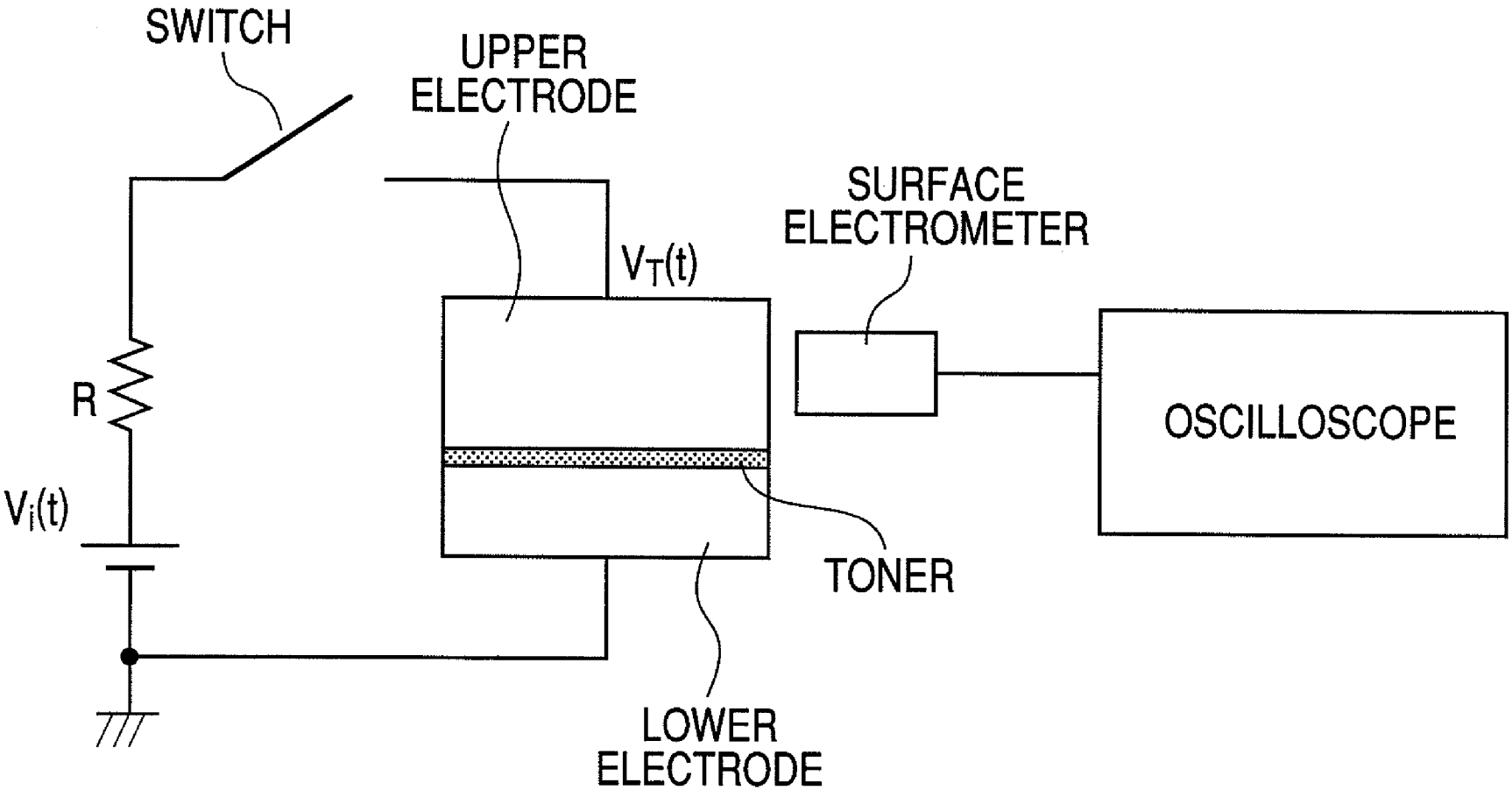
FIG. 28 is a schematic view of an instrument used for measuring toner permittivity.

Using an apparatus shown in FIG. 28, electrical potential change waveform at turning ON/OFF the switch was measured. Based on the measured waveform, the permittivity $\epsilon t$ of the toner was obtained.

To describe more in detail, in the apparatus in FIG. 28, the toner of approximately 30 mm in thickness was uniformly attached to and sandwiched between two flat electrodes; the lower electrode was connected to the ground; and the upper electrode was connected to a high voltage power source via the switch and a resistor R (30 MΩ). In order to record the potential at the upper electrode, a surface electrometer and an oscilloscope were disposed adjacent to the upper electrode.

By turning ON the switch on the apparatus, several hundred voltage was applied to the upper electrode potential, and the curve of rising potential was measured at the upper electrode.

The permittivity $\epsilon$ of the toner layer can be expressed by the following formula 6, which is an equation of charge transport. Based on the curve of the rising potential at the upper electrode, the permittivity $\epsilon$ of the toner layer was obtained. In the following formula 6, L: toner layer height, S: electrode area, R: resistance between the power source and the switch, $V_i$: power source voltage, $V_T$: potential at upper electrode, and $\tau$: relaxation time of toner layer.

$$\varepsilon = \frac{L}{SR} \cdot \frac{V_i - V_T}{\frac{V_T}{\tau} + \frac{dV_T}{dt}} \tag{6}$$

Differential coefficient of the voltage $V_T$ was obtained based on a descending curve of the potential at the upper electrode, which was previously measured, (transition of the potential as time passes at the upper electrode, which was measured when the switch was turned OFF from a state of ON).

The relaxation time of the toner layer can be calculated by the following formula 7. Using the differential coefficient obtained from the descending curve of the potential at the upper electrode, the relaxation time $\tau$ of the toner layer at the voltage $V_T$ was calculated.

$$\tau = -\frac{V}{(dV/dt)} \tag{7}$$

The permittivity $\epsilon$ of the toner layer obtained as described above was divided by the permittivity $\epsilon_0$ in vacuum; thereby the relative permittivity $\epsilon t$ in the toner layer was obtained.

Film Thickness of Photosensitive Member

The film thickness of the photosensitive member was measured as described below.

A plane photosensitive plate having the same layer structure as that of the actual photosensitive layer was prepared on a metal base. The thickness before and after forming the photosensitive layer was measured using a film thickness measure, and the difference therebetween was calculated to obtain the film thickness Ld of the photosensitive layer.

Relative Permittivity of the Photosensitive Member

Relative permittivity and capacitance of the photosensitive member were measured as described below.

A plane photosensitive plate having the same layer structure as that of the actual photosensitive layer was prepared on a metal base. An electrode smaller than the photosensitive plate was brought into contact with the plane photosensitive plate and a DC voltage was applied to the electrode. The electric current was monitored and the obtained current was integrated with time, thereby the amount of electric charge q accumulated in the photosensitive layer was obtained. The above measurement was carried out while changing the value of the DC voltage. Based on the change amount of the electric charge q, the capacitance C of the photosensitive plate was obtained. Using the measured capacitance C, the electrode area S and the film thickness of photosensitive member Ld obtained by the above method, the permittivity $\epsilon$ of the photosensitive member was obtained based on $C=\epsilon S/Ld$. By dividing the obtained permittivity of the photosensitive member by the permittivity $\epsilon_0$ in vacuum, the relative permittivity $\epsilon d$ of the photosensitive member was obtained. In this example, the measurement was made using the plane photosensitive plate. However, by arranging the configuration of the electrode so as to have the same curvature as that of the photosensitive member, the relative permittivity $\epsilon d$ of a drum-shaped photosensitive member can be measured.

Transfer Efficiency

The transfer efficiency of the toner from the photosensitive member onto the transfer material is defined as "λ". Defining the toner weight per unit area in the maximum density portion on the photosensitive member as m1 [mg/cm$^2$]; and the toner weight per unit area on the transfer material when the maximum density image is finally transferred to the transfer material from the photosensitive member as m2 [mg/cm$^2$], the transfer efficiency λ is expressed as λ=m2/m1.

The m2 and m1 in the above formula were measured respectively using the technique described in the above toner bearing amount measurement on the photosensitive member; thereby the transfer efficiency λ was obtained.

Particle Diameter of the Toner

In this specification, the particle diameter of the toner is represented with a weight-averaged particle diameter. The weight-averaged particle diameter of the toner was measured by the following manner.

100 to 150 ml of electrolysis solution added with several ml of interfacial active agent (preferably, alkyl benzene sulfonate) (for example, approximately 1% NaCl solution) was prepared, to which 2 to 20 mg of the toner was added, and dispersed for several minutes with an ultrasonic disperser. The solution was measured using a Coulter counter (TA-II manufactured by COULTER); thereby the weight averaged particle diameter was obtained.

As described above, according to the invention, it is possible to reduce the toner bearing amount while preventing a reduction of the stability and image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-024925, filed Feb. 2, 2007, which is hereby incorporated by reference herein in its entirety.

What is claimed is:

1. An image forming apparatus, comprising:

a photosensitive member;

a developing device which develops an electrostatic image formed on the photosensitive member with a developer having a toner and a carrier, the developing device including a developer carrying member which carries and conveys the developer to a developing position;

a transfer device which transfers a toner image formed on the photosensitive member to a transfer material; and a fixing device which fixes the toner image on the transfer material to the transfer material, wherein assuming that a toner bearing amount in a maximum density image portion of the photosensitive member is $(M/S)_L$ [mg/cm$^2$], an average charge amount of the toner in the maximum density image portion of the photosensitive member is $(Q/M)_L$ [μC/g], an absolute value of a potential difference between a potential of a DC-component of a developing bias applied to the developer carrying member and a potential of the maximum density image portion on the photosensitive member is Vc [V], a toner layer thickness of the maximum density image portion on the photosensitive member is Lt [μm], a thickness of the photosensitive member is Ld [μm], a relative permittivity of the toner layer is εt, a relative permittivity of the photosensitive member is εd, a permittivity in vacuum is ε0, a transmission density in a maximum density image portion on the transfer material after being fixed by the fixing device is Dtmax, a transmission density in an image portion on the transfer material when the toner bearing amount on the transfer material after being fixed by the fixing device is 0.1 mg/cm$^2$ is $Dt_{0.1}$, and a transfer efficiency of the toner from the photosensitive member onto the transfer material is λ, the following formulae are satisfied:

$$0.22 \leqq (M/S)_L \leqq 0.4,$$

$$\left(\frac{Q}{M}\right)_L = \frac{Vc}{\left(\frac{Lt}{2\varepsilon_0\varepsilon_t} + \frac{Ld}{\varepsilon_0\varepsilon_d}\right) \times \left(\frac{M}{S}\right)_L},$$

and assuming that $$\alpha = \frac{(Dt\max - Dt_{0.1})}{\left\{\lambda \times \left(\frac{M}{S}\right)_L - 0.1\right\}},$$

and $\beta = 1/(Q/M)_L$, the following formulae are satisfied:

$$\frac{\frac{(Dt\max - Dt_{0.1})}{\left\{\lambda \times \left(\frac{M}{S}\right)_L - 0.1\right\}}\left(\frac{Lt}{2\varepsilon_0\varepsilon_t} + \frac{Ld}{\varepsilon_0\varepsilon_d}\right) \times \left(\frac{M}{S}\right)_L}{500} \leq \alpha\beta \leq \frac{\frac{(Dt\max - Dt_{0.1})}{\left\{\lambda \times \left(\frac{M}{S}\right)_L - 0.1\right\}}\left(\frac{Lt}{2\varepsilon_0\varepsilon_t} + \frac{Ld}{\varepsilon_0\varepsilon_d}\right) \times \left(\frac{M}{S}\right)_L}{150}$$

$$\alpha\beta = \frac{\frac{(Dt\max - Dt_{0.1})}{\left\{\lambda \times \left(\frac{M}{S}\right)_L - 0.1\right\}}}{150}.$$

2. An image forming apparatus according to claim 1, wherein an average particle diameter of the toner is 5.0 μm or more.

3. An image forming apparatus according to claim 1, wherein a capacitance C of the photosensitive member satisfies the following formula:

$$0.7 \times 10^{-6}[\mathrm{F/m^2}] < C < 2.7 \times 10^{-6}[\mathrm{F/m^2}].$$

4. An image forming apparatus according to claim 1, wherein the image is formed by using a plurality of color toners, and each of the plurality of color toners satisfies the formulae.

5. An image forming apparatus, comprising:

a photosensitive member; and a developing device which develops an electrostatic image formed on the photosensitive member with a developer having a toner and a carrier, the developing device including a developer carrying member which carries and conveys the developer to a developing position, wherein assuming that a toner bearing amount in a maximum density image portion of the photosensitive member is $(M/S)_L$ [mg/cm$^2$], an average charge amount of the toner in the maximum density image portion of the photosensitive member is $(Q/M)_L$ [μC/g], an absolute value of a potential difference between a potential of a DC-component of a developing bias applied to the developer carrying member and a potential of the maximum density image portion of the photosensitive member is Vc [V], a toner layer thickness of the maximum density image portion of the photosensitive member is Lt [μm], a thickness of the photosensitive member is Ld [μm], a relative permittivity of the toner layer is εt, a relative permittivity of the photosensitive member is εd, and a permittivity in vacuum is ε0, the following formulae are satisfied:

$$0.22 \leqq (M/S)_L \leqq 0.4,$$

$$\left(\frac{Q}{M}\right)_L = \frac{Vc}{\left(\frac{Lt}{2\varepsilon_0\varepsilon_t} + \frac{Ld}{\varepsilon_0\varepsilon_d}\right) \times \left(\frac{M}{S}\right)_L} \leqq 150,$$

$$150 \leqq Vc \leqq 500.$$

6. An image forming apparatus according to claim 5, wherein an average particle diameter of the toner is 5.0 μm or more.

7. An image forming apparatus according to claim 5, wherein a capacitance C of the photosensitive member satisfies the following formula:

$$0.7 \times 10^{-6}[\mathrm{F/m^2}] < C < 2.7 \times 10^{-6}[\mathrm{F/m^2}].$$

8. An image forming apparatus according to claim 5, wherein the image is formed by using a plurality of color toners, and each of the plurality of color toners satisfies the formulae.

* * * * *